US011814911B2

(12) United States Patent
Saunders et al.

(10) Patent No.: US 11,814,911 B2
(45) Date of Patent: Nov. 14, 2023

(54) PASSIVE TUBULAR CONNECTION GUIDE

(71) Applicant: NATIONAL OILWELL VARCO, L.P., Houston, TX (US)

(72) Inventors: Christopher J. Saunders, Conroe, TX (US); Neil West, Norco, CA (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 17/305,299

(22) Filed: Jul. 2, 2021

(65) Prior Publication Data

US 2023/0003090 A1 Jan. 5, 2023

(51) Int. Cl.
*E21B 19/24* (2006.01)
*E21B 19/16* (2006.01)

(52) U.S. Cl.
CPC ..... *E21B 19/24* (2013.01); *E21B 19/16* (2013.01)

(58) Field of Classification Search
CPC ..... E21B 19/24; E21B 19/16
See application file for complete search history.

(56) References Cited

U.S. PATENT DOCUMENTS

| | | | |
|---|---|---|---|
| 1,386,210 | A | 8/1921 | Thomas |
| 1,494,524 | A | 5/1924 | Adamson |
| 1,818,278 | A | 8/1931 | Siler |
| 2,109,344 | A | 2/1938 | Selger |
| 2,314,867 | A | 3/1943 | Alexander |
| 2,531,930 | A | 11/1950 | Woolslayer et al. |
| 2,615,681 | A | 10/1952 | True |
| 2,735,556 | A | 2/1956 | Stone |
| 2,810,145 | A | 10/1957 | Forrow |
| 2,885,096 | A | 5/1959 | De |
| 2,946,464 | A | 7/1960 | Guier |
| 3,225,949 | A | 12/1965 | Erickson et al. |
| 3,272,365 | A | 9/1966 | Stevens |

(Continued)

FOREIGN PATENT DOCUMENTS

| | | |
|---|---|---|
| CA | 2911388 A1 | 11/2014 |
| CA | 2855105 A1 | 12/2015 |

(Continued)

OTHER PUBLICATIONS

U.S. Appl. No. 16/098,169, filed Nov. 1, 2018, System and Method for Offline Standbuilding.

(Continued)

*Primary Examiner* — Jonathan Malikasim
(74) *Attorney, Agent, or Firm* — Schwegman Lundberg & Woessner, P.A.

(57) ABSTRACT

A guide mechanism may include a first jaw and a second jaw pivotably coupled to the first jaw. The jaws may include a guide having a bottom pocket for seating arrangement on a box end of a first tubular and a top funnel for laterally guiding a pin end of a second tubular into the box end. The guide mechanism may also include a linkage system secured to the first and second jaws to control pivoting motion of the jaws. The guide mechanism may also include a bias mechanism coupled to the linkage system and configured to impart a biasing force on the jaws via the linkage system. The biasing force may be adapted to resist opening of the jaws such that opening of the jaws occurs when a lateral force is applied to the guide mechanism that overcomes the biasing force.

19 Claims, 13 Drawing Sheets

(56) References Cited

U.S. PATENT DOCUMENTS 3,361,453 A 1/1968 Brown et al.
3,533,516 A 10/1970 Guier
3,615,027 A 10/1971 Ham
3,623,753 A 11/1971 Henry
3,747,789 A 7/1973 Shipley et al.
3,768,663 A 10/1973 Turner et al.
3,840,128 A 10/1974 Swoboda et al.
3,877,583 A 4/1975 Bokenkamp
3,921,823 A 11/1975 Bourree et al.
3,976,207 A 8/1976 Schultz
3,994,350 A 11/1976 Smith et al.
4,042,123 A 8/1977 Sheldon et al.
4,117,941 A 10/1978 Mccleskey, Jr. et al.
4,126,348 A 11/1978 Palmer
4,213,237 A * 7/1980 Whiting ..... E21B 19/16 29/272
4,269,554 A 5/1981 Jackson
4,274,778 A 6/1981 Putnam et al.
4,289,442 A 9/1981 Stevens
4,348,920 A 9/1982 Boyadjieff
4,397,605 A 8/1983 Cowgill et al.
4,531,875 A 7/1985 Krueger
4,591,006 A 5/1986 Hutchison et al.
4,599,778 A 7/1986 Dreyfuss et al.
4,621,974 A 11/1986 Krueger
4,680,519 A 7/1987 Chand et al.
4,697,830 A * 10/1987 Wood ..... E21B 19/24 285/379
4,715,761 A 12/1987 Berry et al.
4,738,321 A 4/1988 Olivier
4,846,357 A 7/1989 Sholl et al.
4,899,095 A 2/1990 Kishi et al.
5,038,871 A 8/1991 Dinsdale
5,211,251 A 5/1993 Woolslayer
5,494,320 A 2/1996 Cerruti
5,813,286 A 9/1998 Hansen
5,921,329 A 7/1999 Armstrong
6,047,771 A 4/2000 Roeynestad
6,260,646 B1 7/2001 Fernandez et al.
6,412,576 B1 7/2002 Meiners
7,137,616 B2 11/2006 Kysely
7,249,639 B2 7/2007 Belik
7,341,281 B2 3/2008 Guesnon et al.
7,370,707 B2 5/2008 McDaniel et al.
7,390,032 B2 6/2008 Hughes
7,493,960 B2 2/2009 Leising et al.
7,726,929 B1 6/2010 Orgeron
7,905,311 B2 3/2011 Brown
7,946,795 B2 5/2011 Orgeron
7,984,757 B1 7/2011 Keast et al.
8,074,484 B2 12/2011 Denkmeier et al.
8,191,637 B2 6/2012 Havinga
8,210,269 B2 7/2012 Hudson et al.
8,317,448 B2 11/2012 Hankins et al.
8,504,206 B2 8/2013 Fudaba et al.
8,550,761 B2 10/2013 Belik et al.
8,690,508 B1 4/2014 Orgeron
9,133,968 B2 9/2015 Elrick et al.
9,291,010 B1 3/2016 Barnes
9,388,923 B2 7/2016 Romano
10,047,908 B1 8/2018 Bohle, II et al.
10,053,934 B2 8/2018 Keogh et al.
10,246,952 B2 4/2019 Trydal et al.
10,384,907 B2 8/2019 Upmeier et al.
10,794,126 B2 10/2020 Magnuson
10,995,564 B2 5/2021 Miller et al.
11,035,183 B2 6/2021 Donnally et al.
11,220,888 B2 1/2022 Ocegueda-Hernandez et al.
11,274,508 B2 3/2022 Mckenzie et al.
2002/0175519 A1 11/2002 Mack et al.
2003/0159854 A1 8/2003 Simpson et al.
2004/0049905 A1 3/2004 Jansch et al.
2004/0057815 A1 3/2004 Woolslayer et al.
2005/0055132 A1 3/2005 Matsumoto et al.
2005/0113971 A1 5/2005 Zhang et al.
2005/0126792 A1 6/2005 Berry
2006/0081379 A1 4/2006 Fehres et al.
2006/0104747 A1 5/2006 Zahn et al.
2006/0124316 A1 6/2006 Pietras
2006/0231344 A1 10/2006 Drzewiecki
2006/0249292 A1 11/2006 Guidry
2007/0062705 A1 3/2007 Schats et al.
2007/0114069 A1 5/2007 Hooper et al.
2007/0228671 A1 10/2007 Norton
2008/0136203 A1 6/2008 Krijnen et al.
2008/0202812 A1 8/2008 Childers et al.
2008/0238095 A1 10/2008 Yater et al.
2008/0296065 A1 12/2008 Standal
2009/0283324 A1 11/2009 Konduc et al.
2010/0163247 A1 7/2010 Wright et al.
2010/0193198 A1 8/2010 Murray et al.
2010/0303586 A1 12/2010 Hankins et al.
2011/0079434 A1 4/2011 Belik et al.
2011/0120730 A1 5/2011 Clasen et al.
2011/0147009 A1 6/2011 Dupal et al.
2011/0226485 A1 9/2011 Seneviratne et al.
2012/0018222 A1 1/2012 Hankins et al.
2012/0259337 A1 10/2012 Del Rio et al.
2013/0075114 A1 3/2013 Dekker et al.
2013/0142607 A1 6/2013 Ditzler
2013/0146305 A1 6/2013 Dupal et al.
2014/0050522 A1 2/2014 Slaughter, Jr. et al.
2014/0054089 A1 2/2014 Sondervik
2014/0083676 A1* 3/2014 Miner ..... E21B 19/24 166/85.5
2014/0097027 A1 4/2014 Marica et al.
2014/0145408 A1 5/2014 Midas et al.
2014/0202769 A1 7/2014 Magnuson
2015/0053424 A1 2/2015 Wiens et al.
2015/0127152 A1 5/2015 Nammoto et al.
2015/0148952 A1 5/2015 Shiratsuchi
2015/0176349 A1* 6/2015 Belik ..... E21B 19/16 285/27
2015/0232272 A1 8/2015 Magnuson
2015/0272579 A1 10/2015 Leimbach et al.
2015/0273688 A1 10/2015 Harada et al.
2015/0275596 A1 10/2015 Hickie
2015/0283704 A1 10/2015 Watanabe
2015/0330162 A1 11/2015 Magnuson et al.
2016/0060979 A1 3/2016 Magnuson
2016/0115745 A1 4/2016 Bisel
2016/0145954 A1 5/2016 Helms et al.
2016/0160586 A1 6/2016 Keogh et al.
2016/0168929 A1 6/2016 Magnuson et al.
2016/0201408 A1 7/2016 Little et al.
2017/0172295 A1 6/2017 Tropper
2017/0204687 A1 7/2017 Yorga et al.
2017/0232620 A1 8/2017 Kalb et al.
2017/0234088 A1 8/2017 Orr et al.
2018/0171724 A1 6/2018 Daigle et al.
2018/0238120 A1 8/2018 Patterson et al.
2018/0245408 A1 8/2018 Keogh et al.
2018/0328112 A1 11/2018 Berry et al.
2018/0334865 A1 11/2018 Miller et al.
2019/0017334 A1 1/2019 Loeyning et al.
2019/0063649 A1 2/2019 Snyder, II
2019/0143532 A1 5/2019 Cutkosky et al.
2019/0145197 A1 5/2019 Callaghan
2019/0309585 A1 10/2019 Miller et al.
2019/0352982 A1 11/2019 Arefi et al.
2020/0032597 A1 1/2020 Jorgic et al.
2020/0040673 A1 2/2020 Donnally et al.
2020/0040674 A1 2/2020 Mckenzie et al.
2020/0131860 A1 4/2020 Lembcke et al.
2020/0208775 A1 7/2020 Eitland et al.
2021/0246738 A1 8/2021 Mckenzie et al.
2021/0293099 A1 9/2021 Carnegie et al.
2021/0301602 A1 9/2021 Mckenzie et al.
2022/0145704 A1 5/2022 Mckenzie

(56) References Cited

U.S. PATENT DOCUMENTS

| | | | | |
|---|---|---|---|---|
| 2023/0073941 | A1* | 3/2023 | De Mul | E21B 19/16 |
| 2023/0119621 | A1 | 4/2023 | Mancuso | |

FOREIGN PATENT DOCUMENTS

| | | | |
|---|---|---|---|
| CN | 108266139 | A | 7/2018 |
| CN | 110792399 | A | 2/2020 |
| EP | 1510302 | A1 | 3/2005 |
| EP | 1953334 | A2 | 8/2008 |
| GB | 2091788 | A | 8/1982 |
| GB | 2532267 | A | 5/2016 |
| JP | H09137689 | A | 5/1997 |
| NO | 20151648 | A1 | 12/2015 |
| WO | WO-8800274 | A2 | 1/1988 |
| WO | 9525216 | | 9/1995 |
| WO | WO-9958811 | A1 | 11/1999 |
| WO | WO-0123701 | A1 | 4/2001 |
| WO | WO-2004018829 | A1 | 3/2004 |
| WO | 2007143842 | A1 | 12/2007 |
| WO | WO-2013082172 | A1 | 6/2013 |
| WO | WO-2014179730 | A1 | 11/2014 |
| WO | WO-2015043740 | A1 | 4/2015 |
| WO | WO-2016024859 | A1 | 2/2016 |
| WO | WO-2016197255 | A1 | 12/2016 |
| WO | WO-2017039996 | A1 | 3/2017 |
| WO | WO-2017087595 | A1 | 5/2017 |
| WO | WO-2017190120 | A1 | 11/2017 |
| WO | WO-2017193204 | A1 | 11/2017 |
| WO | WO-2019195651 | A1 | 10/2019 |
| WO | WO-2020028852 | A1 | 2/2020 |
| WO | WO-2020028853 | A1 | 2/2020 |
| WO | WO-2020028853 | A9 | 2/2020 |
| WO | WO-2020028856 | A1 | 2/2020 |
| WO | WO-2020028858 | A1 | 2/2020 |
| WO | WO-2020151386 | A1 | 7/2020 |
| WO | 2020160440 | A1 | 8/2020 |
| WO | WO-2020172407 | A1 | 8/2020 |
| WO | WO-2021203122 | A1 | 10/2021 |
| WO | 2021226622 | | 11/2021 |
| WO | 2022016168 | A1 | 1/2022 |

OTHER PUBLICATIONS

U.S. Appl. No. 17/310,672, filed Aug. 17, 2021, Dual Activity Top Drive.
U.S. Appl. No. 16/375,927 U.S. Pat. No. 10,995,564, filed Apr. 5, 2019, System For Handling Tubulars on a Rig.
U.S. Appl. No. 17/250,548, filed Feb. 2, 2021, End Effectors for Automated Pipe Handling.
U.S. Appl. No. 16/431,533, filed Jun. 4, 2019, Devices, Systems, and Methods for Robotic Pipe Handling.
U.S. Appl. No. 16/836,365, filed Mar. 31, 2020, Robotic Pipe Handling From Outside a Setback Area.
U.S. Appl. No. 16/431,540 U.S. Pat. No. 11,035,183, filed Jun. 4, 2019, Devices, Systems, and Methods for Top Drive Clearing.
U.S. Appl. No. 17/318,188, filed Jul. 23, 2021, Pipe Handling Arm.
U.S. Appl. No. 16/786,345, filed Feb. 10, 2020, Quick Coupling Drill Pipe Connector.
U.S. Appl. No. 17/248,669, filed Feb. 2, 2021, Robot End-Effector Orientation Contstraint for Pipe Tailing Path.
"U.S. Appl. No. 17/248,669, Notice of Allowance dated Jan. 25, 2022", 8 pgs.
"U.S. Appl. No. 16/098,160, Notice of Allowance dated Feb. 3, 2022", 7 pgs.
"U.S. Appl. No. 17/248,669, Notice of Allowability dated Feb. 3, 2022", 5 pgs.
"U.S. Appl. No. 16/431,533, Non Final Office Action dated Feb. 14, 2022", 15 pgs.
"U.S. Appl. No. 17/248,669, 312 Amendment filed Mar. 2, 2022", 3 pgs.
"U.S. Appl. No. 17/248,669, PTO Response to Rule 312 Communication dated Mar. 9, 2022", 2 pgs.
"U.S. Appl. No. 16/098,160, Corrected Notice of Allowability dated Mar. 25, 2022", 4 pgs.
"U.S. Appl. No. 16/786,345, Non-Final Office Action dated Mar. 28, 2022", 13 pgs.
"International Application Serial No. PCT/US2022/070377, International Search Report dated Mar. 25, 2022", 5 pgs.
"International Application Serial No. PCT/US2022/070377, Written Opinion dated Mar. 25, 2022", 7 pgs.
"Saudia Arabian Application No. 521421161, Office Action dated Apr. 4, 2022", 6 pgs.
"U.S. Appl. No. 16/836,365, Notice of Allowance dated Nov. 3, 2021", 7 pgs.
"International Application Serial No. PCT/US2021/070786, International Search Report dated Nov. 9, 2021", 4 pgs.
"International Application Serial No. PCT/US2021/070786, Written Opinion dated Nov. 9, 2021", 7 pgs.
"U.S. Appl. No. 16/098,160, Response filed Dec. 14, 2021 to Non Final Office Action dated Sep. 15, 2021", 8 pgs.
"U.S. Appl. No. 17/248,669, Examiner Interview Summary dated Dec. 17, 2021", 2 pgs.
"U.S. Appl. No. 17/248,669, Response filed Jan. 5, 2022 to Non Final Office Action dated Oct. 5, 2021", 8 pgs.
"U.S. Appl. No. 16/098,160, Advisory Action dated Jul. 22, 2020", 5 pgs.
"U.S. Appl. No. 16/098,160, Advisory Action dated Aug. 10, 2021", 4 pgs.
"U.S. Appl. No. 16/098,160, Examiner Interview Summary dated Jun. 23, 2020", 3 pgs.
"U.S. Appl. No. 16/098,160, Final Office Action dated Apr. 30, 2020", 7 pgs.
"U.S. Appl. No. 16/098,160, Final Office Action dated May 27, 2021", 8 pgs.
"U.S. Appl. No. 16/098,160, Non Final Office Action dated Sep. 15, 2021", 8 pgs.
"U.S. Appl. No. 16/098,160, Non Final Office Action dated Sep. 30, 2019", 8 pgs.
"U.S. Appl. No. 16/098,160, Non Final Office Action dated Oct. 6, 2020", 8 pgs.
"U.S. Appl. No. 16/098,160, Preliminary Amendment filed Nov. 1, 2018", 5 pgs.
"U.S. Appl. No. 16/098,160, Response filed Jan. 6, 2021 to Non Final Office Action dated Oct. 6, 2020", 7 pgs.
"U.S. Appl. No. 16/098,160, Response filed Jan. 30, 2020 to Non Final Office Action dated Sep. 30, 2019", 8 pgs.
"U.S. Appl. No. 16/098,160, Response filed Jun. 30, 2020 to Final Office Action dated Apr. 30, 2020", 8 pgs.
"U.S. Appl. No. 16/098,160, Response filed Jul. 27, 2021 to Final Office Action dated May 27, 2021", 9 pgs.
"U.S. Appl. No. 16/098,160, Response filed Aug. 24, 2020 to Advisory Action dated Jul. 22, 2020", 9 pgs.
"U.S. Appl. No. 16/098,160, Response filed Aug. 27, 2021 to Advisory Action dated Aug. 10, 2021", 8 pgs.
"U.S. Appl. No. 16/375,927, Advisory Action dated Aug. 11, 2020", 6 pgs.
"U.S. Appl. No. 16/375,927, Corrected Notice of Allowability dated Jan. 26, 2021", 2 pgs.
"U.S. Appl. No. 16/375,927, Examiner Interview Summary dated Apr. 24, 2020", 3 pgs.
"U.S. Appl. No. 16/375,927, Examiner Interview Summary dated Dec. 7, 2020", 7 pgs.
"U.S. Appl. No. 16/375,927, Final Office Action dated Jun. 5, 2020", 10 pgs.
"U.S. Appl. No. 16/375,927, Non Final Office Action dated Feb. 28, 2020", 9 pgs.
"U.S. Appl. No. 16/375,927, Non Final Office Action dated Sep. 24, 2020", 10 pgs.
"U.S. Appl. No. 16/375,927, Notice of Allowance dated Jan. 1, 2021", 8 pgs.
"U.S. Appl. No. 16/375,927, Response filed May 27, 2020 to Non Final Office Action dated Feb. 28, 2020", 10 pgs.

(56) References Cited

OTHER PUBLICATIONS

"U.S. Appl. No. 16/375,927, Response filed Aug. 3, 2020 to Final Office Action dated Jun. 5, 2020", 11 pgs.
"U.S. Appl. No. 16/375,927, Response filed Sep. 8, 2020 to Advisory Action dated Aug. 11, 2020", 10 pgs.
"U.S. Appl. No. 16/375,927, Response filed Dec. 16, 2020 to Non Final Office Action dated Sep. 24, 2020", 8 pgs.
"U.S. Appl. No. 16/431,540, Examiner Interview Summary dated Jan. 19, 2021", 3 pgs.
"U.S. Appl. No. 16/431,540, Final Office Action dated Nov. 19, 2020", 10 pgs.
"U.S. Appl. No. 16/431,540, Non Final Office Action dated Jun. 10, 2020", 13 pgs.
"U.S. Appl. No. 16/431,540, Notice of Allowance dated Feb. 11, 2021", 5 pgs.
"U.S. Appl. No. 16/431,540, Response filed Jan. 19, 2021 to Final Office Action dated Nov. 19, 2020", 11 pgs.
"U.S. Appl. No. 16/431,540, Response Filed Sep. 10, 2020 to Non Final Office Action dated Jun. 10, 2020", 24 pgs.
"U.S. Appl. No. 16/431,540, Supplemental Notice of Allowability dated Mar. 11, 2021", 2 pgs.
"U.S. Appl. No. 16/836,365, Final Office Action dated May 4, 2021", 7 pgs.
"U.S. Appl. No. 16/836,365, Non Final Office Action dated Jan. 25, 2021", 8 pgs.
"U.S. Appl. No. 16/836,365, Notice of Allowance dated Jul. 27, 2021", 7 pgs.
"U.S. Appl. No. 16/836,365, Response filed Apr. 22, 2021 to Non Final Office Action dated Jan. 25, 2021", 8 pgs.
"U.S. Appl. No. 16/836,365, Response filed Jul. 2, 2021 to Final Office Action dated May 4, 2021", 7 pgs.
"U.S. Appl. No. 17/248,669, Non Final Office Action dated Oct. 5, 2021", 8 pgs.
"Canadian Application Serial No. 3,022,888, Voluntary Amendment filed Jul. 12, 2019", 10 pgs.
"International Application Serial No. PCT/CA2017/000125, International Preliminary Report on Patentability dated Nov. 22, 2018", 6 pgs.
"International Application Serial No. PCT/CA2017/000125, International Search Report dated Aug. 14, 2017", 3 pgs.
"International Application Serial No. PCT/CA2017/000125, Written Opinion dated Aug. 14, 2017", 4 pgs.
"International Application Serial No. PCT/CN2019/124443, International Preliminary Report on Patentability dated May 26, 2021", 4 pgs.
"International Application Serial No. PCT/CN2019/124443, International Search Report dated Mar. 5, 2020", 4 pgs.
"International Application Serial No. PCT/CN2019/124443, Written Opinion dated Mar. 5, 2020", 4 pgs.
"International Application Serial No. PCT/US2019/025942, International Preliminary Report on Patentability dated Oct. 30, 2020", 7 pgs.
"International Application Serial No. PCT/US2019/025942, International Search Report dated Jun. 27, 2019", 4 pgs.
"International Application Serial No. PCT/US2019/025942, Response filed Feb. 5, 2020 to Written Opinion dated Feb. 27, 2019", 14 pgs.
"International Application Serial No. PCT/US2019/025942, Response filed Apr. 23, 2020 to Written Opinion dated Apr. 23, 2020", 14 pgs.
"International Application Serial No. PCT/US2019/025942, Response filed Sep. 22, 2020 to Written Opinion dated Jul. 23, 2020", 4 pgs.
"International Application Serial No. PCT/US2019/025942, Written Opinion dated Feb. 24, 2020", 8 pgs.
"International Application Serial No. PCT/US2019/025942, Written Opinion dated Jun. 27, 2019", 9 pgs.
"International Application Serial No. PCT/US2019/025942, Written Opinion dated Jul. 23, 2020", 5 pgs.
"International Application Serial No. PCT/US2019/044974, International Preliminary Report on Patentability dated Nov. 11, 2020", 7 pgs.
"International Application Serial No. PCT/US2019/044974, International Search Report dated Oct. 24, 2019", 6 pgs.
"International Application Serial No. PCT/US2019/044974, Response filed Jun. 2, 2020 to Written Opinion dated Oct. 24, 2019", 13 pgs.
"International Application Serial No. PCT/US2019/044974, Response filed Aug. 18, 2020 to Written Opinion dated Jun. 19, 2020", 4 pgs.
"International Application Serial No. PCT/US2019/044974, Written Opinion dated Jun. 19, 2020", 7 pgs.
"International Application Serial No. PCT/US2019/044974, Written Opinion dated Oct. 24, 2019", 6 pgs.
"International Application Serial No. PCT/US2019/044976, International Preliminary Report on Patentability dated Mar. 9, 2021", 7 pgs.
"International Application Serial No. PCT/US2019/044976, International Search Report dated Oct. 18, 2019", 5 pgs.
"International Application Serial No. PCT/US2019/044976, Response filed Jun. 3, 2020 to Written Opinion dated Oct. 18, 2019", 11 pgs.
"International Application Serial No. PCT/US2019/044976, Response filed Aug. 25, 2020 to Written Opinion dated Jun. 26, 2020", 3 pgs.
"International Application Serial No. PCT/US2019/044976, Written Opinion dated Jun. 26, 2020", 4 pgs.
"International Application Serial No. PCT/US2019/044976, Written Opinion dated Oct. 18, 2019", 8 pgs.
"International Application Serial No. PCT/US2019/044976, Written Opinion dated Nov. 6, 2020", 6 pgs.
"International Application Serial No. PCT/US2019/044979, International Preliminary Report on Patentability dated Nov. 18, 2020", 7 pgs.
"International Application Serial No. PCT/US2019/044979, International Search Report dated Oct. 22, 2019", 6 pgs.
"International Application Serial No. PCT/US2019/044979, Response filed Jun. 3, 2020 to Written Opinion dated Oct. 22, 2019", 12 pgs.
"International Application Serial No. PCT/US2019/044979, Response filed Aug. 25, 2020 to Written Opinion dated Jun. 26, 2020", 3 pgs.
"International Application Serial No. PCT/US2019/044979, Written Opinion dated Jun. 26, 2020", 4 pgs.
"International Application Serial No. PCT/US2019/044979, Written Opinion dated Oct. 22, 2019", 7 pgs
"International Application Serial No. PCT/US2019/044983, International Preliminary Report on Patentability dated Feb. 18, 2021", 8 pgs.
"International Application Serial No. PCT/US2019/044983, International Search Report dated Oct. 22, 2019", 5 pgs.
"International Application Serial No. PCT/US2019/044983, Written Opinion dated Oct. 22, 2019", 6 pgs.
"International Application Serial No. PCT/US2019/124443, Response filed Nov. 24, 2020 to Written Opinion dated Mar. 5, 2020", 10 pgs.
"International Application Serial No. PCT/US2020/019039, International Preliminary Report on Patentability dated Sep. 2, 2021", 6 pgs.
"International Application Serial No. PCT/US2020/019039, International Search Report dated May 15, 2020", 2 pgs.
"International Application Serial No. PCT/US2020/019039, Written Opinion dated May 15, 2020", 4 pgs.
"International Application Serial No. PCT/US2021/070319, International Search Report dated May 31, 2021", 5 pgs.
"International Application Serial No. PCT/US2021/070319, Written Opinion dated May 31, 2021", 6 pgs.
"International Application Serial No. PCT/US2021/070488, International Search Report dated Sep. 8, 2021", 4 pgs.
"International Application Serial No. PCT/US2021/070488, Invitation to Pay Additional Fees dated Jun. 28, 2021", 2 pgs.
"International Application Serial No. PCT/US2021/070488, Written Opinion dated Sep. 8, 2021", 6 pgs.
"International Application Serial No. PCT/US2021/070786, Invitation to Pay Additional Fees dated Sep. 1, 2021", 2 pgs.
"Moveit—Kinematic constraints: Visibility Constraint Class Reference", [online]. [retrieved Apr. 21, 2021]. Retrieved from the Internet: <URL: http://docs.ros.org/en/hydro/api/moveit_core/html/classkinematic__constraints_1_1VisibilityConstraint.html>, (2021), 8 pgs.

(56) References Cited

OTHER PUBLICATIONS

"Moveit—Moving robots into the future", [online]. [archived Dec. 4, 2020]. Retrieved from the Internet: <URL: https://web.archive.org/web/20201204224545/https://moveit.ros.org/>, (2020), 7 pgs.
"International Application Serial No. PCT US2021 070488, International Preliminary Report on Patentability dated Jun. 1, 2022", 5 pgs.
"European Application Serial No. 22182437.8, Extended European Search Report dated Nov. 7, 2022", 7 pgs.
"International Application Serial No. PCT US2022 075797, International Search Report dated Jan. 3, 2023", 2 pgs.
"International Application Serial No. PCT US2022 075797, Written Opinion dated Jan. 3, 2023", 4 pgs.
"U.S. Appl. No. 17/907,705, Non Final Office Action dated Jun. 2, 2023", 8 pgs.
"Saudi Arabian Application Serial No. 522441146, Substantive Examination Report dated Mar. 29, 2023", w/ English Translation, 9 pgs.
"European Application Serial No. 22182437.8, Response filed Jul. 19, 2023 to Extended European Search Report dated Nov. 7, 2022", 24 pgs.

* cited by examiner

PASSIVE TUBULAR CONNECTION GUIDE

FIELD OF THE INVENTION

The present disclosure relates to a guide for assisting with the end-to-end connection of elongated elements. In particular, the present disclosure relates to a guide for assisting with stabbing pin ends of tubulars into box ends of tubulars. Still more particularly, the present disclosure relates to a passive guide for assisting robotic equipment with stabbing pin ends of drill pipe into box ends of drill pipe.

BACKGROUND OF THE INVENTION

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

Many pipe handling operations, such as drill pipe handling operations, are conventionally performed with workers performing manual operations. For example, drilling of wells involves tripping of the drill string, during which drill pipes are lowered into (tripping in) or pulled out of (tripping out) a well. Tripping may typically occur in order to change all or a portion of the bottom hole assembly, such as to change a drill bit. Where drill pipe is tripped into a well, stands or lengths of drill pipe may be supplied from a storage position in a setback area of the drill rig and connected end-to-end to lengthen the drill string in the well. Prior to tripping and/or during tripping, lengths of drill pipe may also be connected end-to-end to create pipe stands. Where drill pipe is tripped out of a well, stands or lengths of drill pipe may be disconnected from the drill string and may be positioned in the setback area.

As with other pipe handling operations, tripping and, thus, the connection of stands end-to-end has conventionally been performed with human operators that manually place a stabbing guide. In particular, while hoisting equipment may be used to carry the load of a stand of drill pipe during trip in and trip out operations, human operators may typically maneuver the drill pipe stands around the drill floor, such as between the well center and the setback area. For example, a first human operator may be positioned on the drill floor, at or near the well, to maneuver a lower end of drill pipe stands as they are tripped into or out of the well, while a second human operator may be positioned on or above the racking board to maneuver an upper end of drill pipe stands as the stands are moved between the well and the setback area. Operators often use ropes and/or other tools to maneuver the drill pipe stands on or above the drill floor. The operators may also use a clam shell type guide for helping to guide pin ends of drill pipe into box ends of drill pipe. This guide can help with the alignment of the pipes. The guide may be manually moved into place on a top of a drill string by the deckhands. With the guide in place, a top drive elevator may, for example, lift a pipe stand into position above the drill string and stab the pin end of the pipe stand into the box end of the upper most pipe in the drill string relying on the guide to position the pin end of the pipe stand. Once the pin end of the upper pipe is stabbed into the box end of the lower pipe and the upper pipe is spun into the lower pipe, the operator may actuate a lever, for example, to open the clamshell guide and remove it from the connected pipes. Such work is labor-intensive and can be dangerous.

Moreover, trip in and trip out operations may be limited by the speed at which the human operators can maneuver the stands between well center and the setback area.

Robotic pipe handling systems may be used to handle pipe to assist with and/or perform the above pipe handling operations on a drill rig. The robots may include a series of links that are hingedly and/or pivotally connected to one another and perform a multitude of operations using selectable tools referred to as end effectors. While helpful to have a robot to assist with pipe handling, the detailed lever actuation on current pipe stabbing guides may be difficult for a robot to perform. Moreover, electrical, hydraulic, or other power may not be desirable to aid in opening/closing a stabbing guide. That is, while a robot may have power for moving the robot, particular actuation power for opening and closing a tool being used by the robot may not be present or desirable in the robotic drilling environment or in other environments.

BRIEF SUMMARY OF THE INVENTION

The following presents a simplified summary of one or more embodiments of the present disclosure in order to provide a basic understanding of such embodiments. This summary is not an extensive overview of all contemplated embodiments and is intended to neither identify key or critical elements of all embodiments, nor delineate the scope of any or all embodiments.

In one or more embodiments, a guide mechanism may include a first jaw and a second jaw pivotably coupled to the first jaw. The first and second jaws may form a guide having a bottom pocket adapted for seating arrangement of the guide on a box end of a first tubular and a top funnel configured for laterally guiding a pin end of a second tubular into the box end. The guide mechanism may also include a linkage system secured to the first and second jaws and adapted to control pivoting motion of the jaws. The guide mechanism may also include a bias mechanism coupled to the linkage system and configured to impart a biasing force on the first jaw and the second jaw via the linkage system. The biasing force may be adapted to resist opening of the jaws such that opening of the jaws occurs when a lateral force is applied to the guide mechanism that overcomes the biasing force.

In one or more embodiments, a guide mechanism may include a first jaw and a second jaw pivotally coupled to the first jaw at a pivot point and forming a tubular connection guide. The guide mechanism may also include a pair of main links pivotally coupled to one another at a central location outside the first and second jaw and proximate the pivot point. The pair of main links may extend away from the central location and along respective first and second jaws to respective free ends. The free ends may be pivotally coupled to the first jaw and the second jaw, respectively, at first and second outer pivot points. The guide mechanism may also include a biasing mechanism resistant to compression and arranged between the first and second outer pivot points.

In one or more embodiments, a method of guiding a tubular connection may include placing a guide on a box end of a first tubular and seating the box end in a bottom pocket of the guide. The method may also include suspending a second tubular above the first tubular and lowering a pin end toward the box end. The method may also include guiding the pin end with the guide into the box end and pulling the guide laterally off of the first and second tubular, wherein pulling of the guide in a lateral direction opens the guide. As the stabbing guide clears the tubulars, it may close based on a biasing force so as to prepare for a next placement.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in one or more embodiments, relates to devices, systems, and methods for guiding the connection of tubulars. In particular, a passive tubular connection guide may be provided that is particularly adapted for use without a power source to open and close the guide. For example, the passive tubular connection guide may be used without compressed air, hydraulic power, electric power, or other power source for opening and closing the guide. Rather, a robot, user, tool arm, or other manipulating device or system may operate the guide in a manner that allows for opening and closing of the guide simply by motion of the guide relative to the tubulars. In the context of well drilling, this approach to a tubular connection guide may obviate the need for hydraulic lines, electrical lines, air lines, or other power-providing cords that may otherwise be draped across the drill floor, not to mention obviating the need for a hydraulic pump, generator, compressor, or other energy source.

Figure 1:
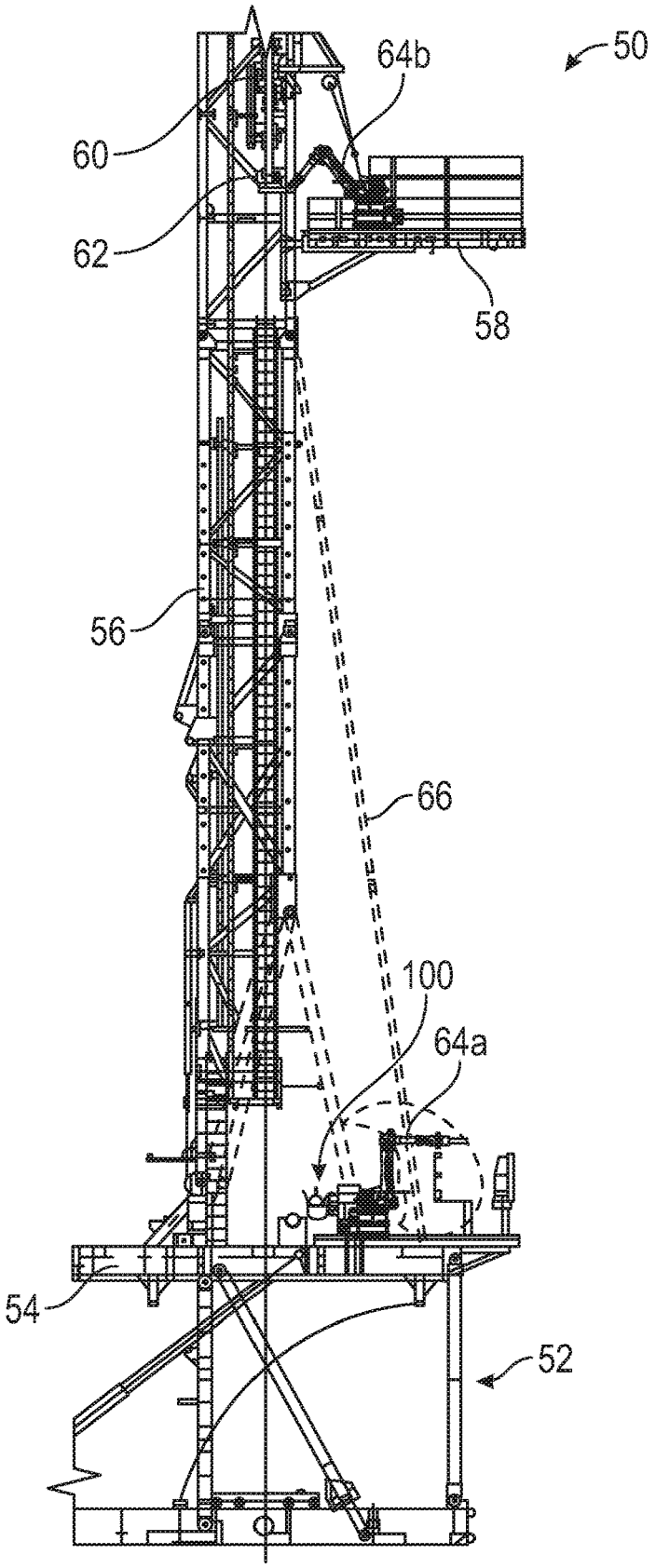
FIG. 1 is an elevation view of a drill rig having a robotic system and a passive tubular connection guide, according to one or more embodiments.

FIG. 1 is an elevation view of a drill rig 50 having a robotic system and a passive tubular connection guide 100, according to one or more embodiments. As shown, the drill rig 50 may include a support structure 52 supporting a drill floor 54 and a mast 56. The drill rig 50 may include a racking board 58 extending laterally from the mast 56 and robotic handlers 64*a/b* may be arranged on the drill floor 54 and the racking board 58. The drill rig 50 may include a top drive 60 with a pipe elevator 62. As described in more detail below, the top drive 60, top drive elevator 62 and the robotic handlers 64*a/b* may operate in a coordinated tripping process to trip drill pipe or other tubulars 66 into and out of a well bore. In one or more embodiments, the robotic handlers 64*a/b* may rely on interchangeable tools that may be selectively secured to the ends of the robotic arms to allow the robotic handlers 64*a/b* to perform particular operations in the process.

Figure 2:
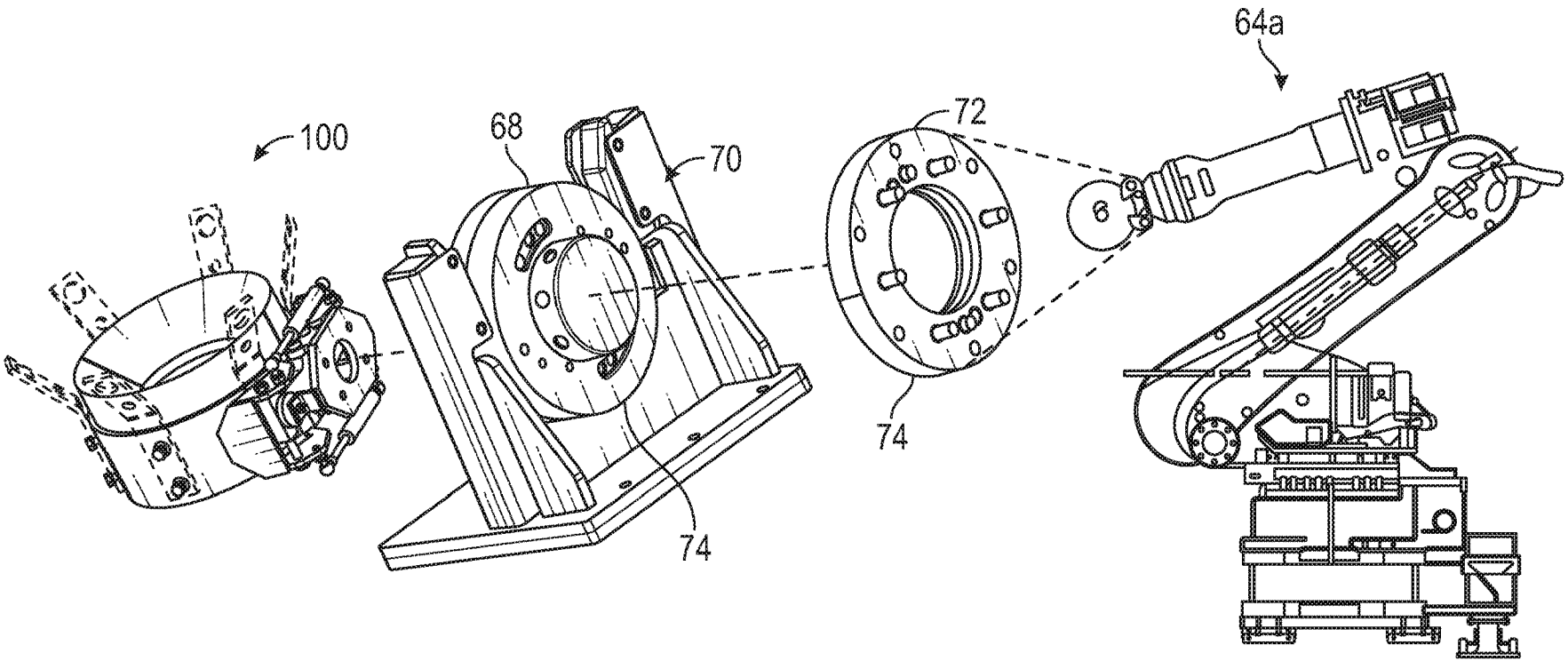
FIG. 2 is a perspective view of a passive tubular connection guide with a passive rotation disconnect for selectively securing the guide to a robotic arm, according to one or more embodiments.

As shown in FIG. 2, for example, a passive tubular connection guide 100 may be bolted or otherwise secured to a tool portion 68 of a remote connection interface 74 such as a passive rotation disconnect and may be stationed in a saddle or other holder 70. The robotic handler 64*a* may have a proximal portion 72 of the remote connection interface 74 secured thereto. The robotic handler 64*a* may use the remote connection interface 74 to selectively pick up or set down the passive tubular connection guide 100. Operation of the remote connection interface 74 and the guide 100 may be performed without the need for external power extending to them. One example of a remote connection interface 74 may be a passive rotation disconnect and may be the same or similar to the device described in International Patent Application PCT/US2021/070488 entitled Passive Rotation Disconnect and filed on Apr. 30, 2021, the content of which is hereby incorporated by reference herein in its entirety.

As discussed in more detail below, the robotic handler 64*a* may use the passive tubular connection guide 100 to assist with tripping operations by guiding a free end of a suspended tubular into a box end of a drill string extending into a well bore. While the passive tubular connection guide 100 has been described as being used by a robotic system, this discussion is simply for purposes of providing one example use of the passive tubular connection guide 100 and nothing in the present application shall foreclose other uses of the passive tubular connection guide 100 including manual use. Moreover, while the passive tubular connection guide 100 has been discussed in the context of drilling tubulars, the passive tubular connection guide 100 may be used in other contexts as well where, for example, end-to-end connection of tubulars is being performed.

Figure 3:
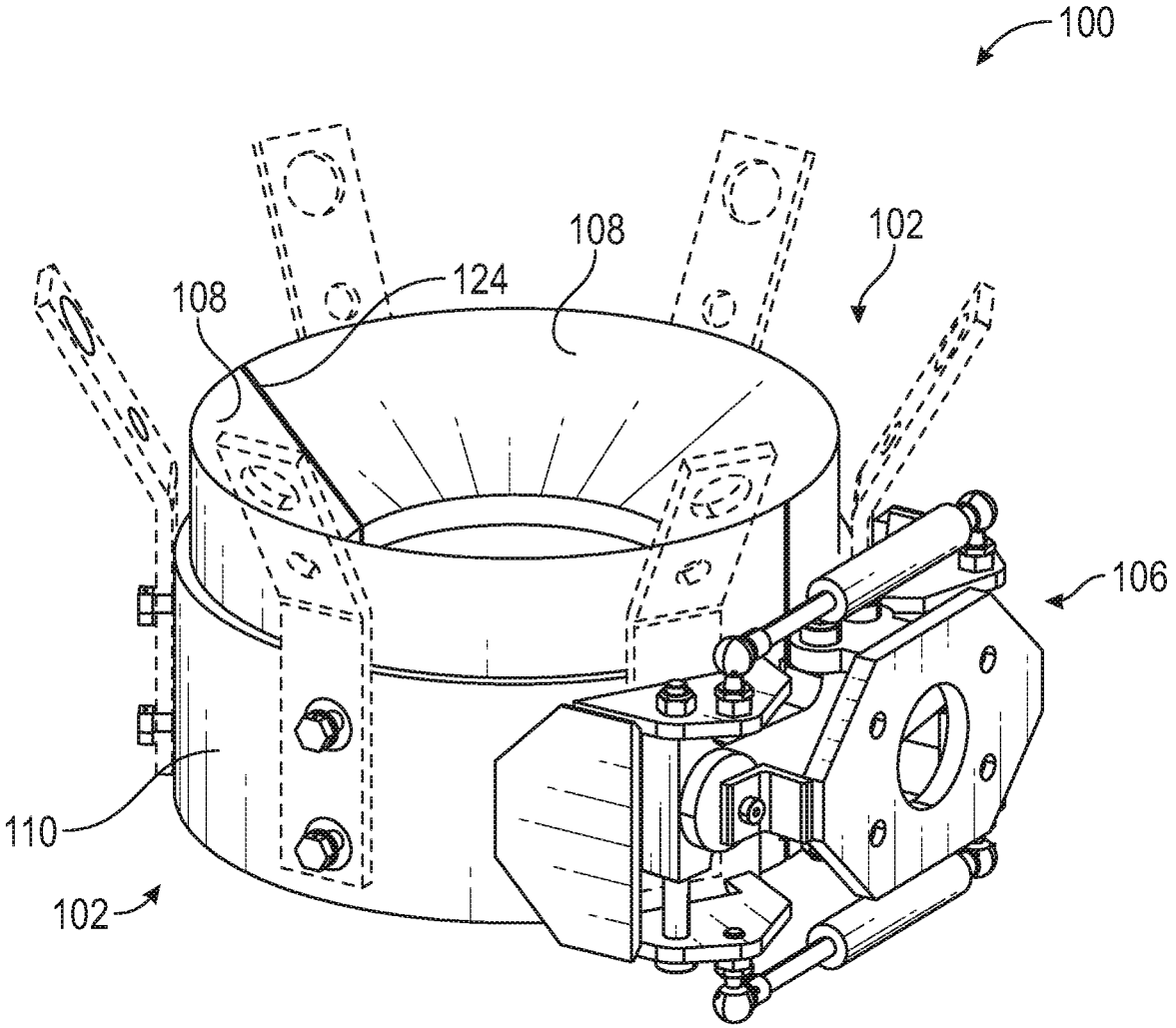
FIG. 3 is a perspective view of a passive tubular connection guide, according to one or more embodiments.
Figure 4:
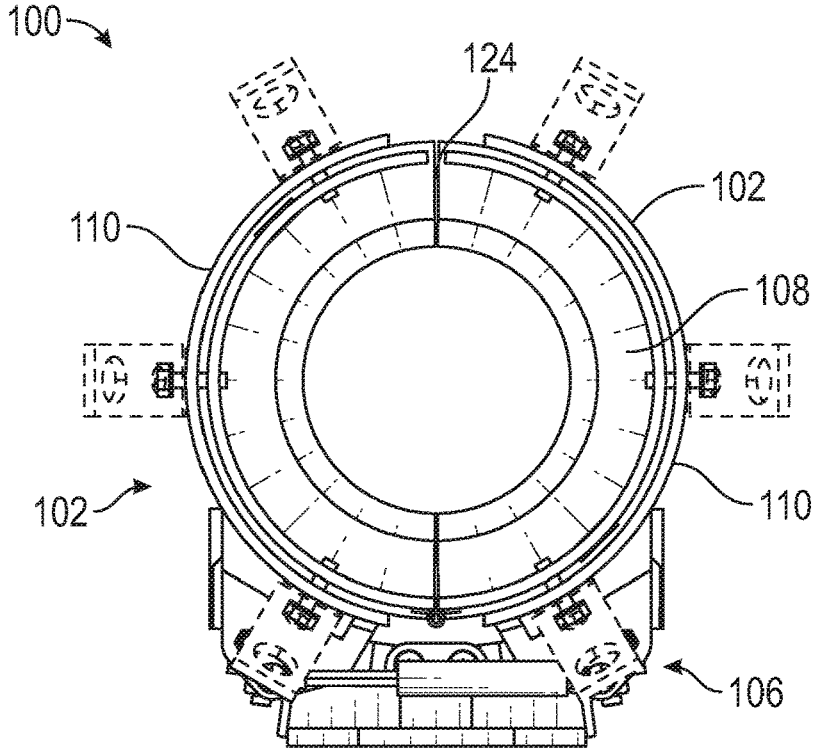
FIG. 4 is a top view thereof.
Figure 5:
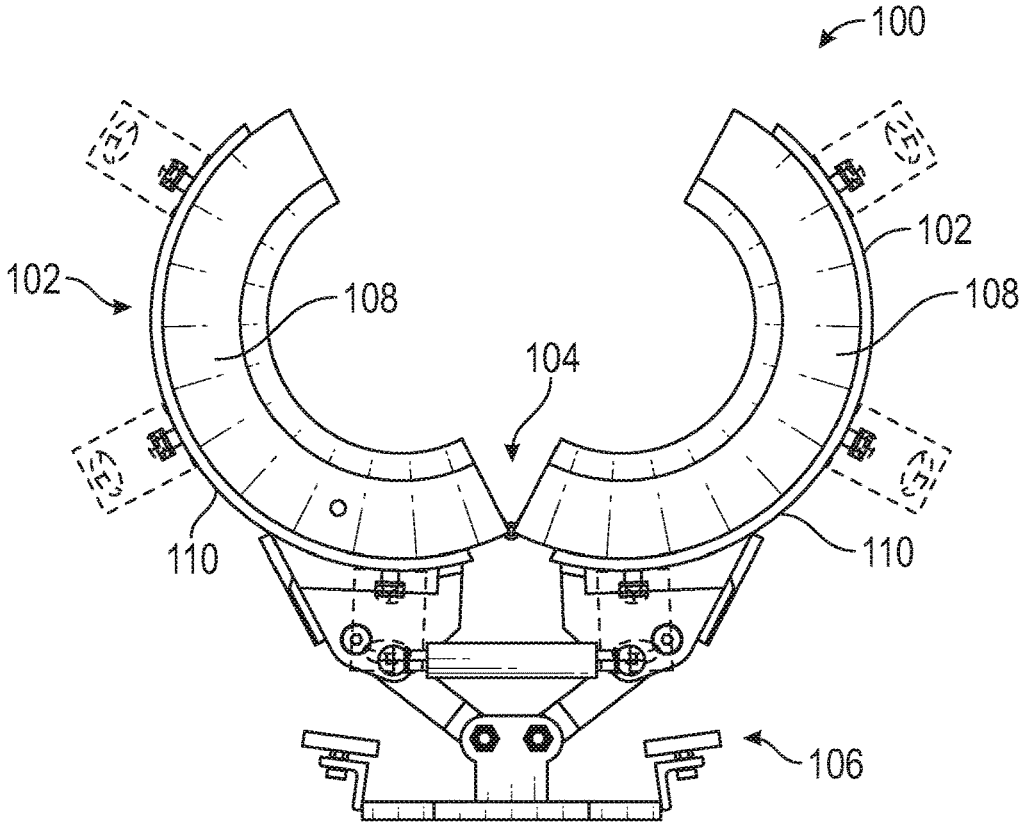
FIG. 5 is a top view thereof with the guide in an open condition.
Figure 6:
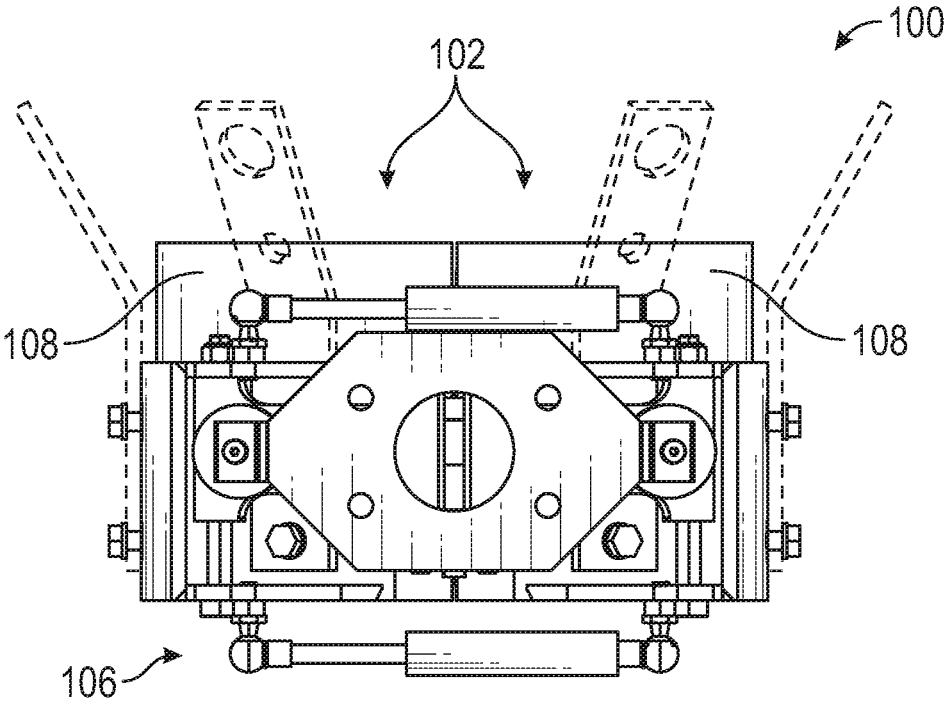
FIG. 6 is a rear view thereof.
Figure 7:
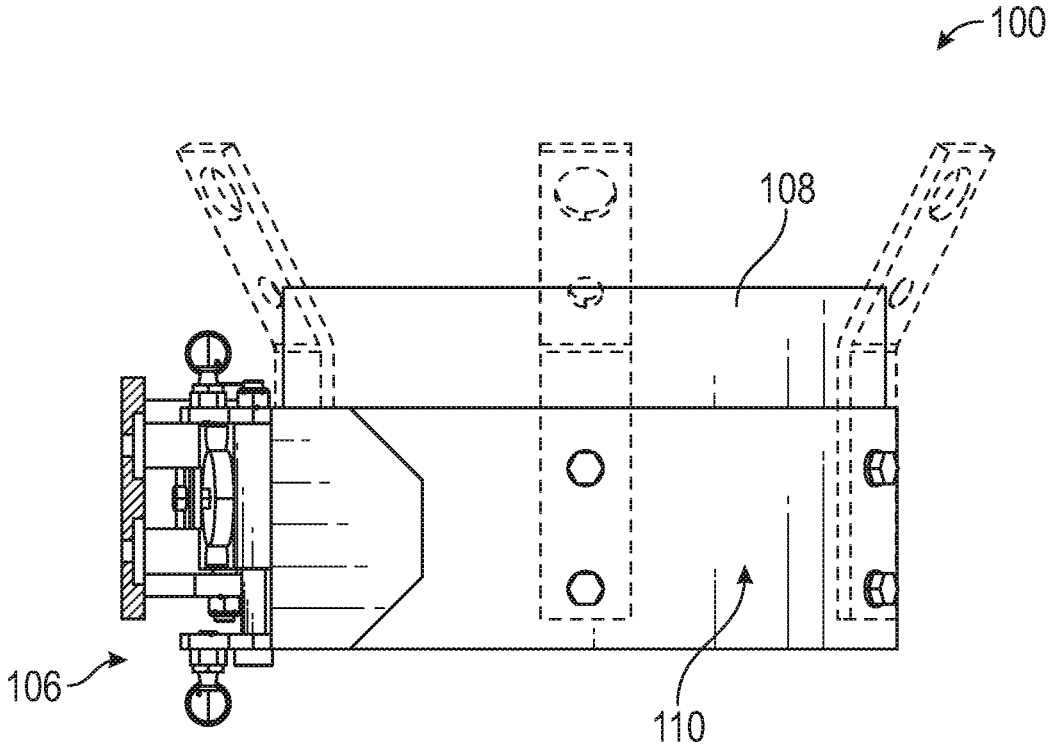
FIG. 7 is a side view thereof.

FIG. 3 is a perspective view of a passive tubular connection guide 100, according to one or more embodiments. The passive tubular connection guide 100 may be configured for placement over a box end 76 of a pipe in a drill string and further configured for guiding a pin end 78 of another pipe into the box end 76. (see FIGS. 16*a*-16*d*) The passive tubular connection guide 100 may be further configured for lateral removal from the connected tubulars 66 after guiding and preliminary connection of the tubulars 66 is complete. As shown in FIGS. 3-7, the passive tubular connection guide 100 may include first and second jaws 102 coupled to one another with a pivot mechanism 104 (see FIG. 5) and a linkage system 106 may also be provided.

The first and second jaws 102 may be adapted to open and close in clamshell fashion. Each of the jaws 102 may form opposing portions or halves of the guide 100 and, together, may be adapted for seated arrangement on a box end 76 of a pipe or tubular 66 and for funnel-like guiding of a pin end 78 into the box end 76. As shown, the jaws 102 may each include a liner portion 108 and a bracket 110. When the jaws 102 are closed, the liner portions 108 may, together, form a liner and the brackets 110 may, together, form a collar.

Figure 8:
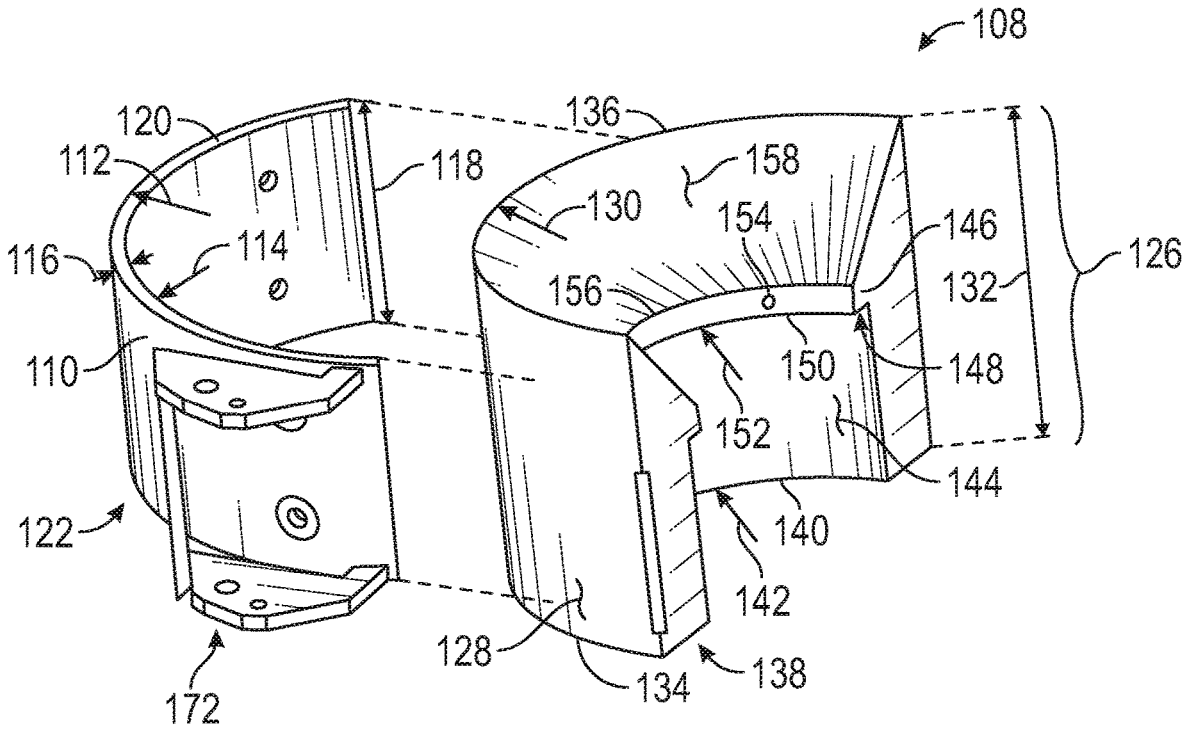
FIG. 8 is a perspective view of a bracket and a liner portion, according to one or more embodiments.

With reference to FIGS. 3-7, the brackets may be configured to provide an interface between the linkage system 106 and the first and second jaws 102. As shown in FIG. 8, the bracket 110 of each jaw 102 may include a substantially semi-circular element or plate having an outer radius 112 and an inner radius 114 where the difference between the outer and inner radius defines a thickness 116. The plate may have a height 118 extending between top and bottom semi-annular surfaces 120/122. In one or more embodiments, the substantially semi-circular plates may stop short of a hinge or pivot point on one side of the guide 100 and a seam or joint 124 on an opposite side of the guide 100. The brackets 110 may also have a linkage interface 172 which is discussed in more detail below in conjunction with the linkage system 106.

With continued reference to FIG. 8, the liner portion 108 of each jaw 102 is shown. The liner portion 108 may be configured for physically interacting, together with a corresponding liner portion 108, with a box end 76 and a pin end 78 of a set of tubulars that are to be joined and for guiding the pin end 78 into the box end 76. As shown, the liner portion 108 may include a substantially thick and semi-circular body portion 126 having an outer surface 128 adapted for engagement by a respective bracket 110. That is, for example, the outer surface 128 may be a substantially radiused surface having a radius 130 the same or similar to the radius 114 of the inside surface of the bracket 110. The outer surface 128 may have a height 132 extending between a bottom edge 134 and a top edge 136. The liner portion 108 may include a bottom semi annular surface 138 having an outer edge coinciding with the bottom edge 134 of the outer surface and defined by the radius 130 of the outer surface 128. The bottom semi annular surface 138 may also have an inner edge 140 defined by a radius 142 substantially smaller than the radius 130 of the outer surface 128, thus, defining a substantially thick wall of the body portion 126. The radius 142 of the inner edge 140 may be selected to be slightly larger, but similar in size to an outer radius of a box end 76 of a selected size of drill pipe or other tubular 66. An inner semi cylindrical wall 144 may extend upward from the inner edge 140 defining one half of a bore or bottom pocket extending upward from the bottom surface 138 and into the body portion 126. When placed adjacent another same or similar liner portion 108, the two may form the full bore or bottom pocket on a bottom side of the guide 100. In one or more embodiments, the inner semi cylindrical wall 144 may extend upward from the bottom a distance ranging between approximately ⅓ and ⅞ of the height 132 of the body portion 126 or between approximately ½ and ¾ of the height 132 of the body portion 126, or approximately ⅔ of the height 132 of the body portion 126. A lip, catch, rib, or other protrusion 146 may be provided at the top of the inner semi cylindrical wall 144, which may function to allow the guide 100 to rest on a box end 76 of a tubular 66. The protrusion 146 may extend radially inward relative to the semi cylindrical wall 144 forming an annular stop surface 148. The annular stop surface 148 may have an inner edge 150 defined by a radius 152. The radius 152 may be selected to be smaller than the radius 142 of the inner semi-cylindrical wall 144, but larger than a pin end 78 of a tubular 66 such that the pin end 78 may pass through the guide 100 and into a box end 76 of a lower tubular 66. The inner edge 150 of the annular stop surface 148 may give way to a chamfered edge 154 in the form of a semi cylindrical inner ribbon with a radius the same as the inner edge 150 of the annular stop surface 148 and extending a short distance upward from the annular stop surface 148 to a relief edge 156. The remaining height of the inner portion of the body portion 126 may include a diverging surface 158 that extends upward from the relief edge 156 at an angle to meet the top edge 136 of the outer surface 128 at a semi-circular edge that forms a semi peripheral point around the top of the liner portion 108. When placed adjacent another liner portion 108 with a same or similar shape, the diverging surfaces 158 of the two liner portions 108 may form a conical or funnel shaped guide for physically guiding a pin end 78 of the tubular 66 to the center of the guide 100 and into a box end 76 of a lower tubular 66.

Figure 9:
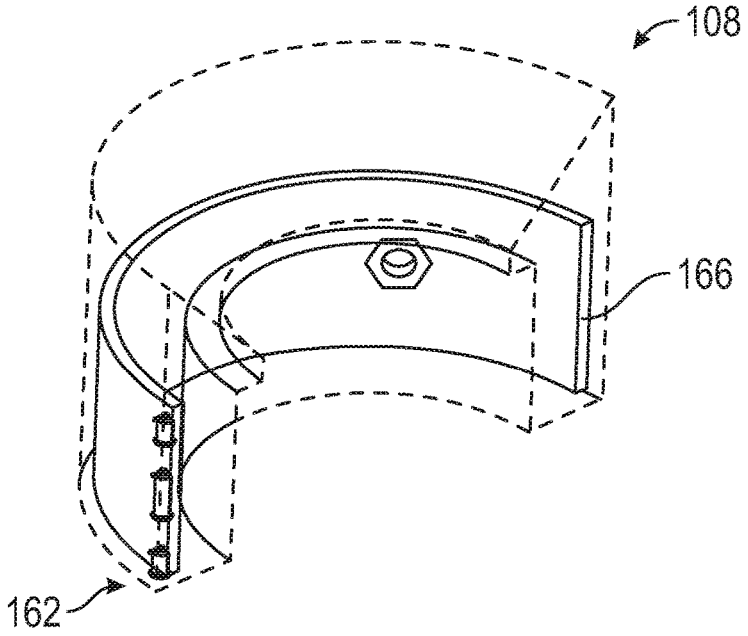
FIG. 9 is a transparent view of a liner portion, according to one or more embodiments.
Figure 10:
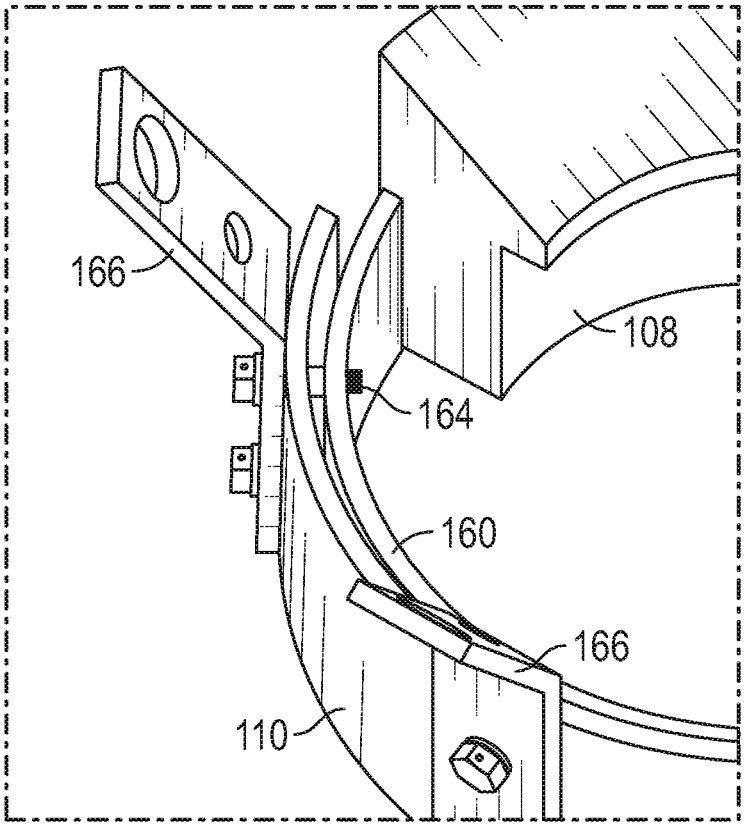
FIG. 10 is a breakaway view of a core within a liner, according to one or more embodiments.
Figure 11:
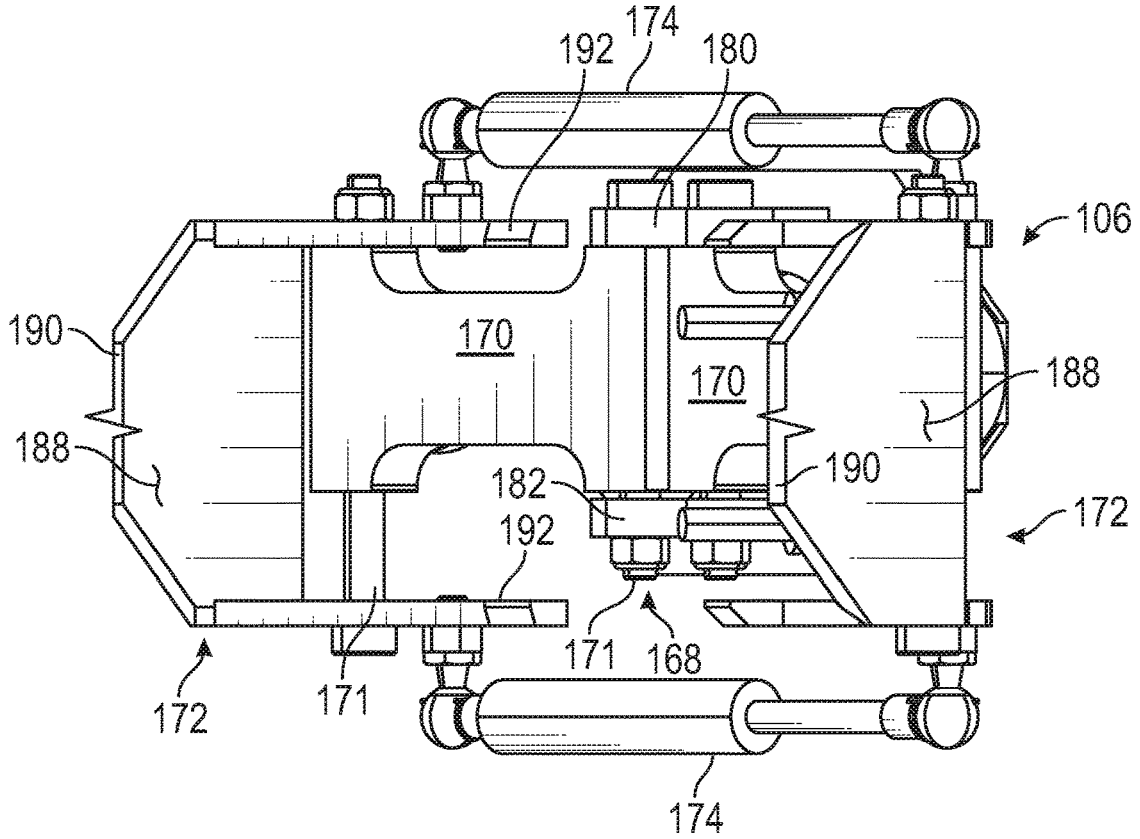
FIG. 11 is a front side perspective view of a linkage system, according to one or more embodiments, where the semicircular plates of the brackets have been omitted for clarity.
Figure 12:
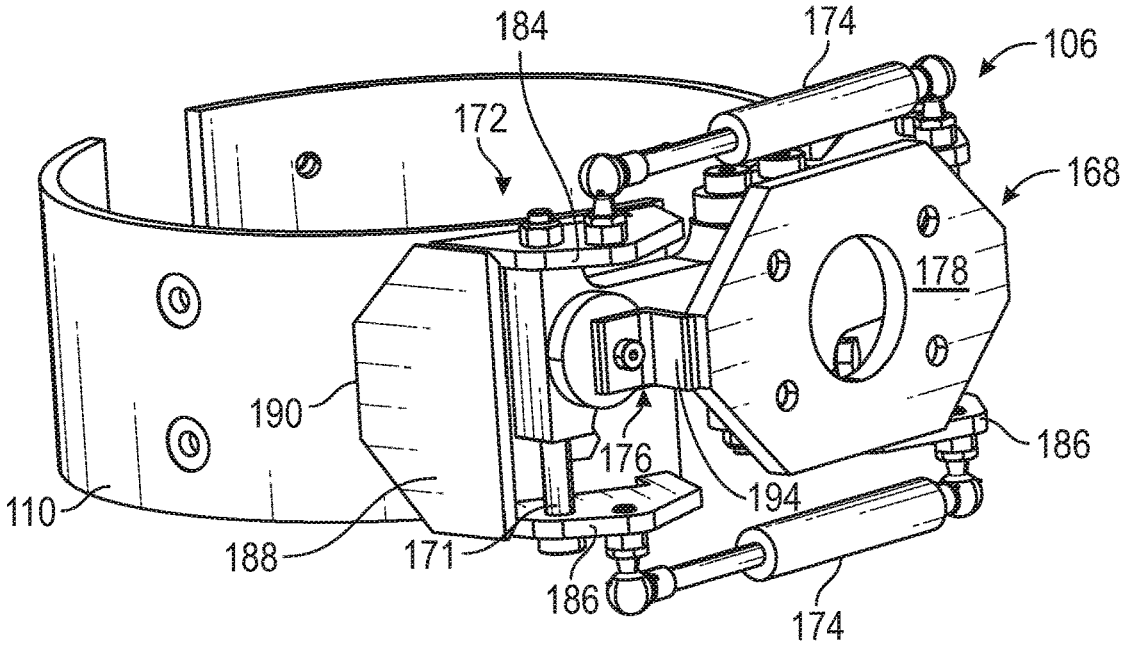
FIG. 12 is a back side perspective view of a linkage system, according to one or more embodiments.

In one or more embodiments as shown in FIG. 9, the liner portion 108 may be reinforced with an internal core 160. The internal core 160 may be molded within the liner portion 108 to stiffen or reinforce the liner portion 108. As shown, the internal core 160 may include a semi-circular plate similar to the bracket 110, but having smaller radii such that the internal core 160 fits within the liner portion 108. In one or more embodiments, the liner portion may be injection molded, overmolded, or otherwise formed around the internal core 160. As shown, the internal core 160 may include a hinge component 162 or other pivoting component on one end thereof that is arranged to extend out of one side of the liner portion 108 so as to engage a hinge component 162 or other pivoting component on an opposing inner core 160. The hinge component 162 on each of two adjacent internal cores 160 may be secured to one another with a hinge pin to create the pivot mechanism 104 (see FIG. 5) for the two liner portions 108 and to establish a pivot axis about which the two liner portions 108 may pivot between an open condition (see FIG. 5) and a closed condition (see FIG. 4). The internal core 160 may also provide for a strong internal structure for attaching the brackets 110 to the liner portions 108. For example, as shown in FIG. 10, bolts or other fasteners 164 may extend from outside the bracket 110, through the bracket, into the liner portion 108 and threadingly engage bores in the core plate 160 so as to pull or press the bracket against the liner portion 108. In one or more embodiments, pipe doping brackets 166 may be included as part of this connection.

With the jaws 102 described, the linkage system 106 that controls or manages the opening and closing operation of the jaws 102 may be described. That is, the linkage system 106 may be adapted to maintain the jaws 102 in a closed condition unless/until a sufficient radial force acting radially and/or generally parallel to a the joint 124 between the free ends of the jaws 102 is sufficient to overcome a biasing closing force. As shown in FIGS. 11-15, the linkage system 106 may include a central bracket 168, a pair of main links 170, a biasing mechanism 174, and a detent mechanism 176. As mentioned above, the brackets 110 may include a linkage interface 172 for interfacing with the linkage system. Each of these parts may be taken in turn. It is noted that the semicircular plate portions of the brackets 110 in FIG. 11 have been omitted to allow for better viewing of the linkage system 106.

The central bracket 168 may be adapted to provide a grasping or mounting location for a user. For example, as shown in FIG. 2, the central bracket 168 may include a back plate 178 with a bolt pattern adapted for securing the guide 100 to a remote connection interface 74, directly to a robot arm, directly to a tool arm, or for securing another operable element. In one or more embodiments, a handle or other gripping device may be provided extending from the back plate 178. The central bracket 168 may also be configured to provide a common location for securing the pair of main links 170 such that operation of the links 170 is relative to one another and relative to the central bracket 168. As shown, the central bracket 168 may include a top bracket plate 180 and a bottom bracket plate 182 each extending toward the jaws 102 from the back plate 178 (e.g., opposite the back plate connection to a tool arm or remote connection interface). The top and bottom bracket plates 180/182 may be adapted for securing the pair of main links 170 to the central bracket 168. As shown, a base end of each link 170 may be placed between the top and bottom brackets 180/182 and a bolt, pin, or other elongate element 171 may be arranged through the top and bottom brackets 180/182 and through the base end of each respective link 170. The elongate elements 171 may be substantially adjacent one another and may establish pivot axes for the main links 170. The pivot axes may extend parallel to one another such that pivoting motion of the main links 170 is parallel to one another and since the main links 170 are arranged between shared top and bottom brackets 180/182, the pivoting motion of the pivot links 170 may also be in a same plane.

The pair of main links 170 may extend from their pivoting connection to the central bracket 168 generally laterally and in opposite directions along respective brackets 110. The pair of main links 170 may be configured to pivot relative to the central bracket 168 between a relatively flat configuration where each link is extending in substantially opposite directions and a more v-shaped configuration where each link 170 is extending partially in opposite directions but also in a direction toward the liner 108. In the former condition of the links 170, the jaws 102 of the guide 100 may be closed and in the latter condition of the links 170, the jaws 102 of the guide 100 may be open.

Figure 13:
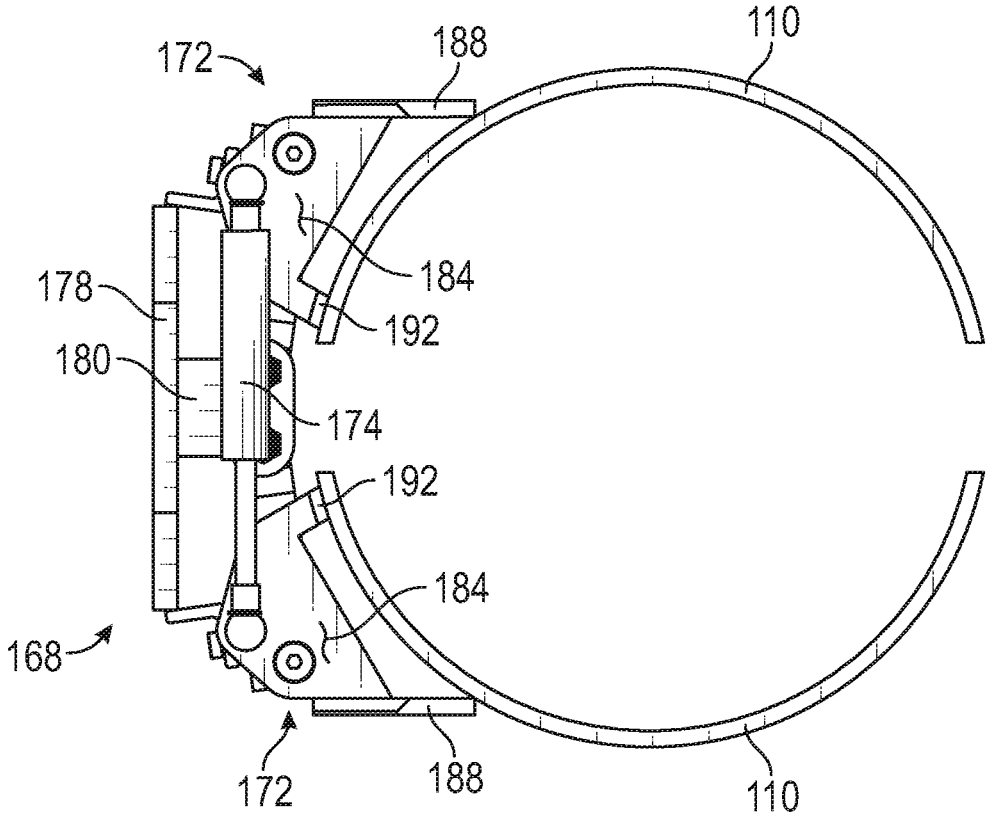
FIG. 13 is a top view of the linkage system in a closed condition, according to one or more embodiments.
Figure 14:
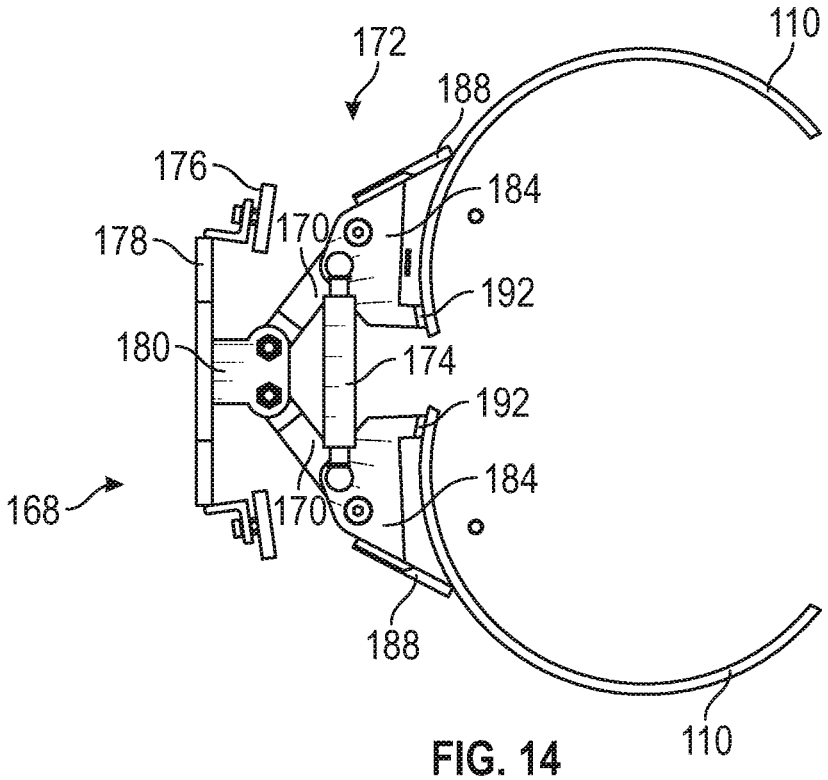
FIG. 14 is a top view of the linkage system in an open condition, according to one or more embodiments.

The links may be secured to the brackets 110 at a linkage interface 172 on the brackets 110. The linkage interface 172 may be part of respective brackets 110 and may be configured for establishing a pivoting connection between the free ends of the links 170 and the bracket 110 of each jaw 102. The linkage interface 172 may also provide an attachment point for one or more biasing mechanisms 174. As shown, the linkage interface 172 may include upper and lower plates 184/186 secured to one another by a closure plate 188 extending between the outboard edges of the upper and lower plates 184/186. The closure plate 188 may extend forward toward the semicircular plate of the bracket 110 and may include a nose 190 formed from upper and lower chamfered forward corners of the closure plate 188. The nose 190 of the closure plate may be secured to the semicircular plate portion of the bracket 110. As shown in FIGS. 13 and 14, the upper and lower plates 184/186 may have a generally flat front edge and a segmented back edge to provide connection points for the links 170 and the biasing mechanism 174. That is, the linkage interface 172 may be sized to receive the free end of the main links 170 between the upper and lower plates 184/186 and an elongate element 171 may extend through the upper and lower plates 184/186 and through the free end of the main link 170 to establish a substantially vertical axis about which the linkage interface 172 may rotate relative to the main link 170. On a central bracket side of the elongate element, a biasing mechanism 174 may be secured to each of the upper and lower plates 184/186. The upper and lower plates 184/186 may each include an inner thumb, tab, or standoff 192 secured to the semicircular plate portion of the bracket.

The biasing mechanism 174 may extend laterally across the linkage system 106. As shown, a biasing mechanism 174 may extend between each of the upper plates 184 and another biasing mechanism 174 may extend between each of the lower plates 186. The biasing mechanism 174 may be biased toward an extended position as shown in FIG. 13. In one or more embodiments, the biasing mechanism may be in the form of spring cylinders, or another type of biasing mechanism may be provided. In one or more embodiments, the biasing mechanisms on the top and bottom of the linkage 106 may be oriented oppositely as shown.

Figure 15:
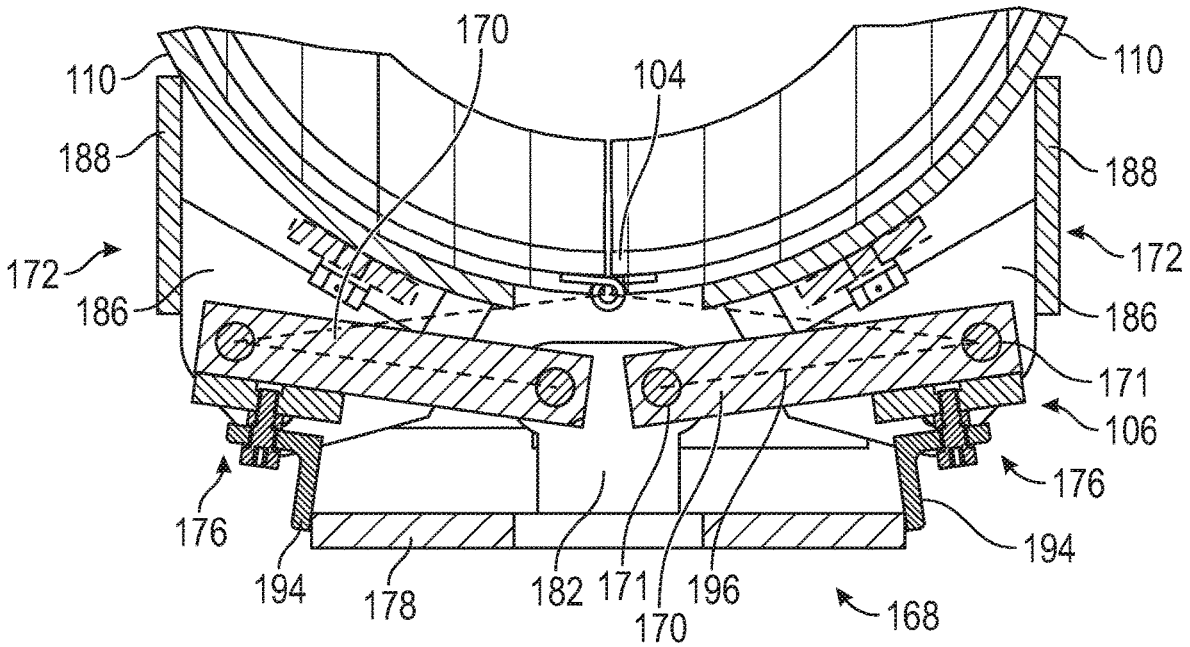
FIG. 15 is a cross-sectional view of the linkage system, according to one or more embodiments.

One or more detent mechanisms 176 may be arranged to extend from the central bracket 168 and may be adapted to hold the main links 170 in a generally straight (e.g., extending in substantially opposite directions) condition unless/until a force is present to release the detent. In one or more embodiments, the detent mechanism 176 may include one or more magnets extending off of the sides of the back plate 178 of the central bracket 168 via brackets 194. That is, as shown in FIG. 15, a bracket 194 such as an L-bracket may be provided on either side of the back plate 178 providing a mounting surface for a magnet that may face the back side of a respective main link 170. As shown in FIG. 15, when the guide 100 in a closed condition, the magnet may be pressed against or arranged in close proximity to a back side of the main link 170 and, as such, may function to hold the main link 170 in a substantially straight condition extending substantially opposite the direction of the other main link 170. Magnets may be provided on each side of the central bracket 168 and, as such, both main links 170 may be held. Unless or until the magnet force is overcome and sufficient separation between the magnet and the main links 170 is present, the magnet may exhibit a detent force functioning to hold the linkage 106 in the closed condition. In one or more embodiments, the magnets may be omitted and a stronger biasing force may be used in lieu of a detent mechanism. In still other embodiments, the main links may move passed center to create a detent force.

As shown in the cross-section of FIG. 15, the linkage system 106 may have an overall arrangement in the shape of a diamond formation 196 having hinges or pivot points on all corners and a biasing mechanism 174 extending from one corner to an opposite corner thereby biasing the diamond formation 196 in an elongated condition. However, upon pulling in opposite directions on the corners of the diamond formation not having the biasing mechanism 174, the biasing mechanism 174 may be compressed allowing the diamond formation 196 to be less elongate unless/until the pulling force is released. As shown, two of the four sides of the diamond formation 196 may include the pair of main links 170. The other two sides of the diamond formation 196 may each be made up, collectively, of a linkage interface 172 and a liner portion 108. The pair of main links 170 may be pivotally coupled to one another at a substantially common point at the central bracket 168. The liner portions 108 may be pivotally coupled to one another at the pivot mechanism 104. The linkage interface 172 and liner portion 108 may each be pivotally coupled to respective main links 170 at the linkage interface 172. The biasing mechanism 174 may extend across the diamond formation 196 between the free ends of the main links 170. Notably, the features of the guide 100 are arranged such that widening out or reduction of the elongate nature of the diamond formation 196 also opens the jaws 102. Moreover, the lateral extension of the central bracket 168 may be such that the detention mechanism 176 engages the diamond formation 196 at or near the free ends of the main links 170. Holding the free ends of the links 170 against relative rotation to the central bracket 168 may resist opening of the diamond formation 196 and doing so at or near the free ends of the links 170, provides a relatively high level of resistance to rotation of the main links 170 due to the engagement of the links 170 at a relatively large distance from their common pivot point. The central bracket 168 and detention magnets may, thus, function as a splint along an elongated side of the diamond formation 196.

In view of the above, one example guide mechanism may be described a bit differently as including a first jaw 102 and a second jaw 102 pivotally coupled to the first jaw 102 at a pivot point 104 and forming a tubular connection guide 100. The guide mechanism may also include a pair of main links 170 pivotally coupled to one another at a central location outside the first and second jaw 102 and proximate the pivot point 104. That is, the jaws 102, when closed may have an inside portion for handling tubulars and an outside portion outside the clamping region of the jaws 102. So, the central location may be central to the pair of main links 170, but may be outside of the clamping region of the jaws 102 and near the pivot point 104 of the jaws. The pair of main links 170 may extend away from the central location and along respective first and second jaws 102 to respective free ends. The free ends may be pivotally coupled to the first jaw 102 and the second jaw 102, respectively, at first and second outer pivot points. That is, while the linkage interfaces 172 have been described as being secured to the semicircular plate and pivotally coupled to the links 170, here, we are simply saying the free ends of the links 170 may be pivotally coupled to the jaws 102 in some way and we have suggested this location be termed the outer pivot points. This could very well be the pivot connection between the linkage interfaces 172 and the links 170, but another outer pivot point may also be provided. Moreover, as described here, a portion of each jaw 102 and the pair of main links 170, may, thus, form a diamond formation 196. The example guide mechanism may also include a biasing mechanism 174 resistant to compression and arranged between the first and second outer pivot points. In one or more embodiments, the example guide mechanism may also include a detent mechanism 176 adapted to hold the pair of main links 170 in a generally parallel arrangement. That is, as shown in FIG. 15, for example, when the diamond formation 196 is elongated, the pair of main links 170 may extend in almost exactly opposite directions and, as such, be generally parallel. In one or more embodiments, the detent mechanism 176 may include a central bracket 168 and a pair of magnets arranged at or near the outer pivot points. In still further embodiments, the central bracket 168 may be adapted for engagement by a tool arm.

In operation and use, the present guide may be used for tripping drill pipe into a well or otherwise accommodating the stabbing of tubular connections while protecting relatively delicate surfaces such as pipe threads, for example. That is, with reference to FIG. 1, a robotic handler 64*b* at the racking board 58 may grasp a top portion of a tubular 66 with an end effector and may tip the tubular 66 to deliver a top portion of the tubular to the top drive elevator 62. The top drive elevator 62 may grasp the top of the tubular 66 and lift the tubular 66 while the robotic handler 64*a* at the drill floor 54 grasps the bottom of the tubular 66 with an end effector and guides the bottom of the tubular 66 as it swings toward well center. The drill string in the well bore may have a top end that stops a short distance above the drill floor 54 and, having retrieved another tubular 66, the top drive elevator 62 may suspend the tubular 66 above and generally in line with the drill string. The robotic handler 64*a* at the drill floor 54 may replace its end effector with a passive tubular connecting guide 100 by placing the end effector in a stand and releasing the end effector using a remote connection interface 74, such as a passive rotation disconnect, and engaging the tubing guide 100 using a the remote connection interface 74. That is, and as shown in FIG. 2, the passive tubular connection guide 100 may be bolted or otherwise secured to a remote connection interface 74 and may be positioned in a stand or holder. The robotic handler 64*a* may have a robot portion configured for engaging the remote connection interface 74 secured to an end of a manipulator arm. The remote connection interface 74 may allow the robot to passively retrieve a variety of different tools.

Figure 16A:
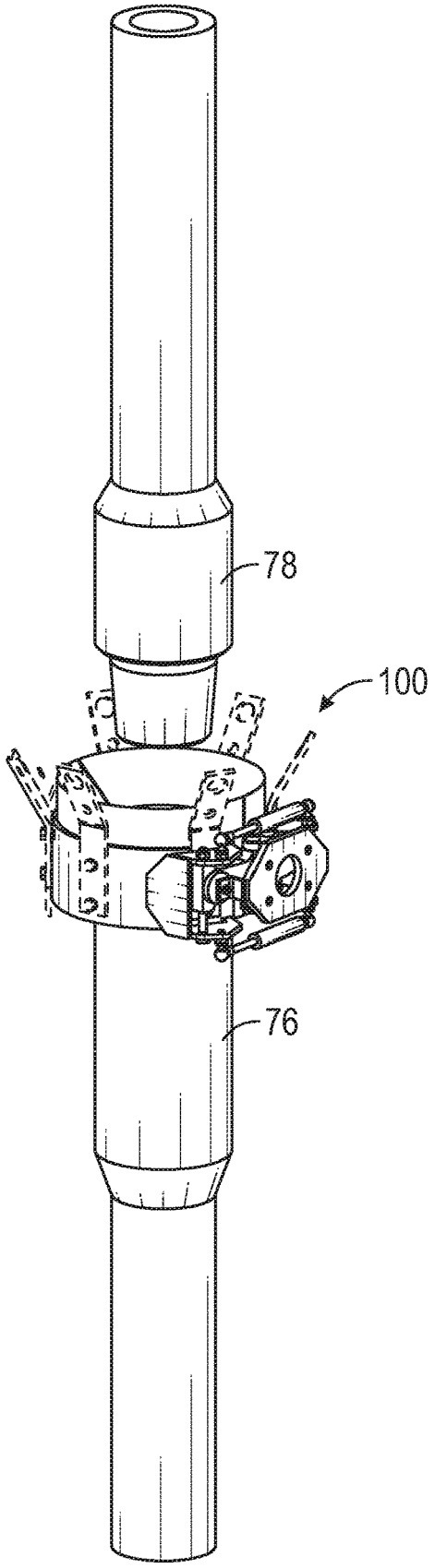
FIG. 16A is a perspective view of the passive tubing guide in place on a pipe string poised to receive a pipe or pipe stand, according to one or more embodiments.
Figure 16B:
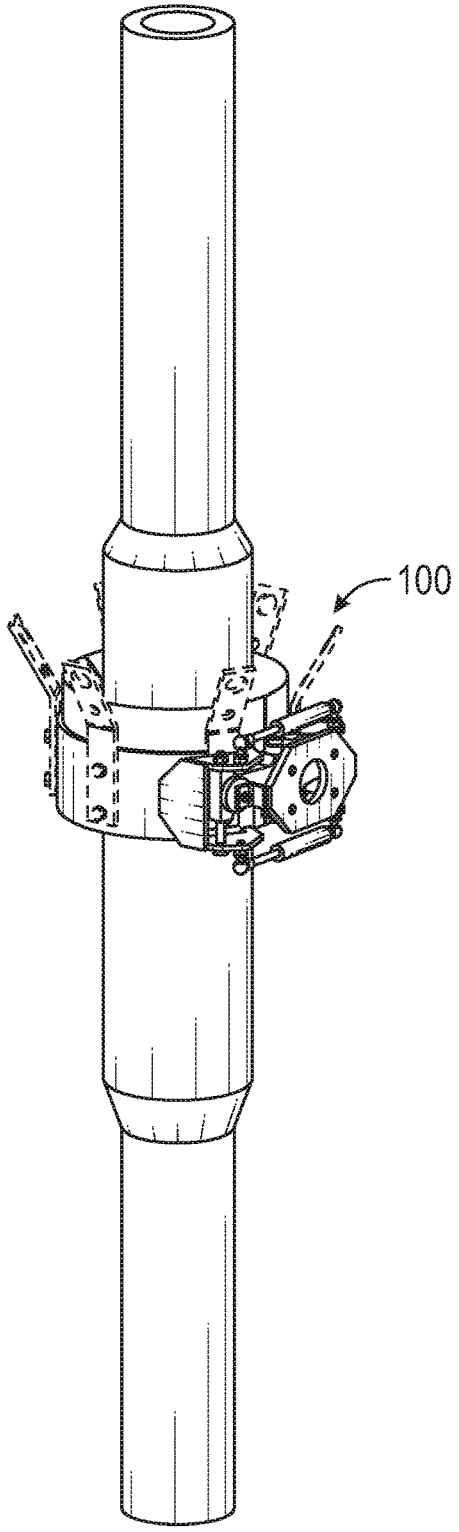
FIG. 16B is a perspective view of the passive tubing guide in place on a pipe string and receiving the pipe or pipe stand, according to one or more embodiments.
Figure 16C:
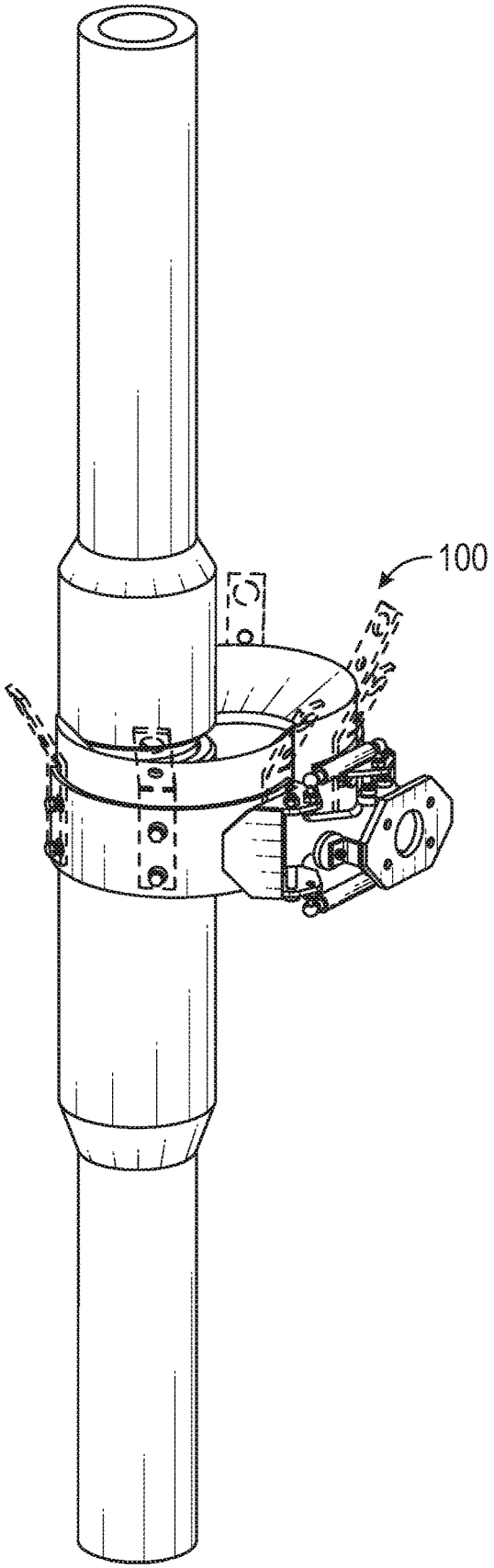
FIG. 16C is a perspective view of the passive tubing guide in a partially removed state, according to one or more embodiments.
Figure 16D:
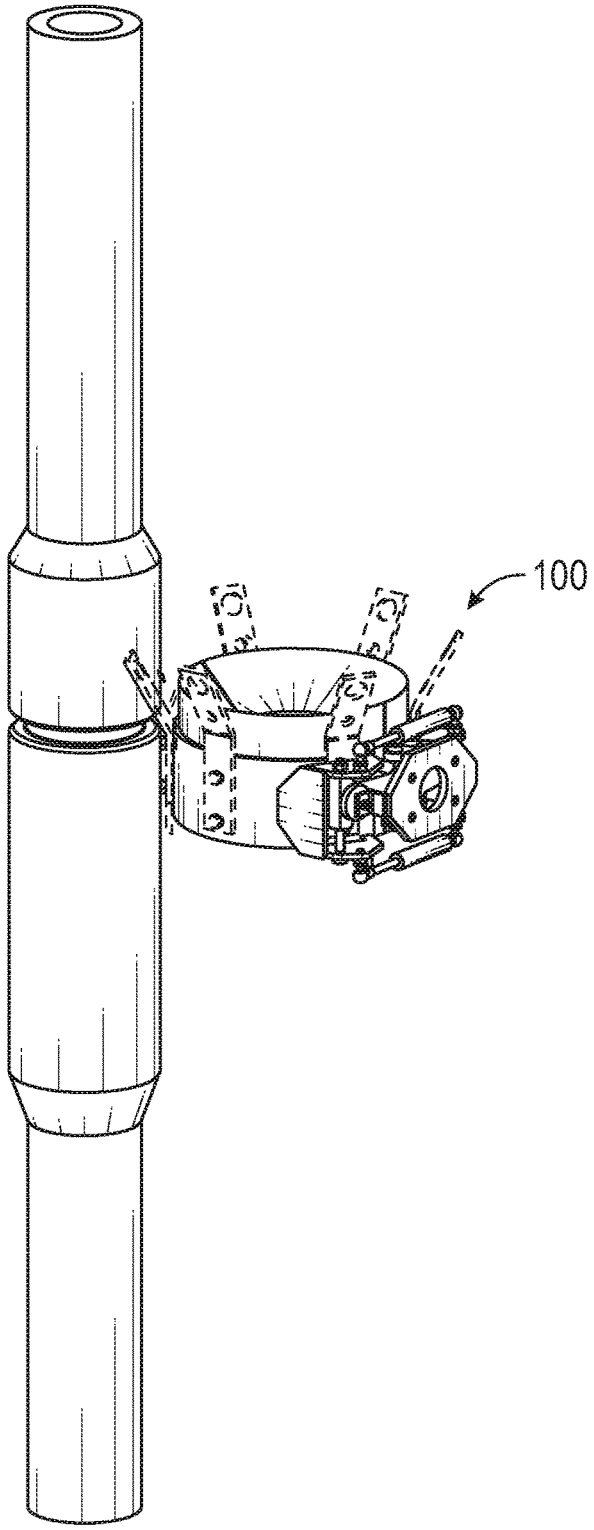
FIG. 16D is a perspective view of the passive tubing guide in a fully removed state, according to one or more embodiments.
Figure 17:
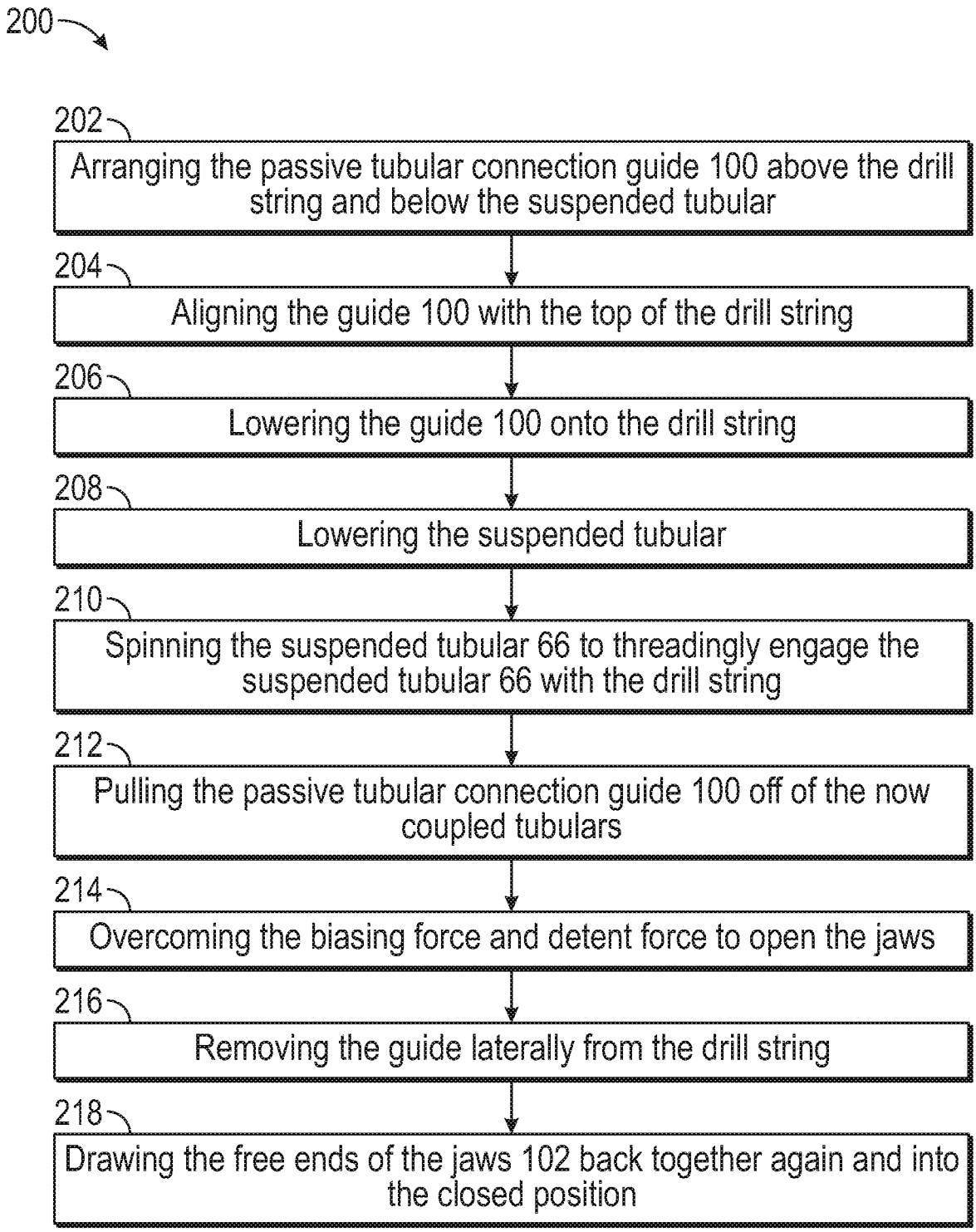
FIG. 17 is a diagram depicting a method of use of the passive tubular connection guide, according to one or more embodiments.

With the passive tubular connection guide 100 secured to its arm, the robotic handler 64*a* may perform a method 200 of guiding a tubular connection as shown in FIG. 17 and as portrayed in FIGS. 16*a*-16*b*. However, a manual user or other operator may also perform this method 200 and nothing shall be construed to require robotics for operation of the guide 100. As shown in FIG. 16*a*, the passive tubular connection guide 100 may be arranged above the drill string and below the suspended tubular (202), aligned with the top of the drill string (204), and lowered onto the drill string (206). As shown in FIG. 16*b*, the bottom pocket of the guide 100 may nestle or seat onto the box portion 76 of the tubular 66. The top drive may then lower the suspended tubular (208) relying on the guide 100 to guide the pin end 78 of the suspended tubular 66 into a box end 76 of the drill string. The top drive may spin the suspended tubular 66 to threadingly engage the suspended tubular 66 with the drill string (210) thereby preliminarily securing the tubular 66 to the drill string. In one or more embodiments, the spinning may be performed before removing the guide 100 or the guide may be removed before the spinning operation. The robotic handler 64*a* or other user may then pull the passive tubular connection guide 100 off of the now coupled, preliminarily coupled, or stabbed tubulars (212). As shown in FIG. 16*c*, the pulling of the guide 100 off of the tubulars 66 may generate a lateral force on the guide 100 extending generally away from the linkage 106 and passing generally through the seam 124 between the free ends of the jaws 102. The circular surface of the tubular 66 may cause this force to result from two radially extending loads on the tips of the jaws 102. Under this force, which acts generally orthogonally to the biasing mechanisms across the diagonal formation 196, the detent force and the biasing force may be overcome and the guide 100 may open and compress the biasing mechanism 174 generating a compressive force therein (214). The opening of the guide 100 may free the guide up to be removed laterally from the now extended drill string as shown in FIG. 16*c* (216). As the guide is removed from the drill string, the tubular may maintain separation between the free ends of the jaws 102 and maintain the compressive force in the biasing mechanism 174. As shown in FIG. 16*d*, upon pulling the guide free from the tubulars 66, the resistance to the compressive force in the biasing mechanism 174 may be removed and the biasing mechanism 174 may extend thereby drawing the free ends of the jaws 102 back together again and into the closed position (218).

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A guide mechanism, comprising:

a first jaw and a second jaw pivotably coupled to the first jaw, the first and second jaws forming a guide having a bottom pocket adapted for seating arrangement of the guide on a box end of a first tubular and a top funnel configured for laterally guiding a pin end of a second tubular into the box end;

a linkage system secured to the first and second jaws and adapted to control pivoting motion of the jaws, wherein the linkage system includes a pair of main links pivotally coupled to one another at a central location outside the first and second jaw; and a bias mechanism coupled to the linkage system and configured to impart a biasing force on the first jaw and the second jaw via the linkage system, the biasing force adapted to resist opening of the jaws such that opening of the jaws occurs when a lateral force is applied to the guide mechanism that overcomes the biasing force.

2. The guide mechanism of claim 1, further comprising a detent mechanism configured to maintain the jaws in a closed position.

3. The guide mechanism of claim 2, wherein the detent mechanism comprises magnets.

4. The guide mechanism of claim 1, wherein the first jaw and the second jaw each comprise a liner portion and a bracket.

5. The guide mechanism of claim 4, wherein the linkage system is secured to the first and second jaws via respective brackets.

6. The guide mechanism of claim 1, wherein the linkage system comprises:

a central bracket;

a pair of main links pivotally secured to the central bracket and extending laterally therefrom to respective free ends; and a pair of linkage interfaces each pivotally coupled to respective free ends of the pair of main links and secured to a respective first jaw or second jaw.

7. The guide mechanism of claim 6, further comprising a detent mechanism arranged on the central bracket.

8. The guide mechanism of claim 7, wherein the detent mechanism comprises a magnet arranged to magnetically couple to a link of the pair of main links when the jaws are in a closed position.

9. The guide mechanism of claim 6, wherein the bias mechanism comprises a compression resistant element arranged between the pair of linkage interfaces.

10. The guide mechanism of claim 6, wherein the linkage system in conjunction with a portion of the jaws comprises a diamond formation.

11. The guide mechanism of claim 10, wherein the biasing mechanism is a compression resistant mechanism extending across the diamond formation.

12. The guide mechanism of claim 11, wherein the detention mechanism comprises a pair of magnets extending to the free ends of the pair of main links from the central bracket.

13. The guide mechanism of claim 12, where the central bracket and the pair of magnets form a splint for the pair of main links along an elongate side of the diamond formation.

14. A guide mechanism, comprising:

a first jaw and a second jaw pivotally coupled to the first jaw at a pivot point and forming a tubular connection guide;

a pair of main links pivotally coupled to one another at a central location outside the first and second jaw and proximate the pivot point, the pair of main links extending away from the central location and along respective first and second jaws to respective free ends, the free ends being pivotally coupled to the first jaw and the second jaw, respectively, at first and second outer pivot points;

a biasing mechanism resistant to compression and arranged between the first and second outer pivot points; and a detent mechanism adapted to hold the pair of main links in a generally parallel arrangement.

15. The guide mechanism of claim 14, wherein the detent mechanism comprises a central bracket and a pair of magnets arranged at or near the outer pivot points.

16. The guide mechanism of claim 15, wherein the central bracket is adapted for engagement by a tool arm.

17. A method of guiding a tubular connection, the method comprising:

placing a guide on a box end of a first tubular and seating the box end in a bottom pocket of the guide, wherein, the guide comprises a pair of jaws biased in a closed position about the first tubular with a biasing force;

suspending a second tubular above the first tubular;

lowering a pin end toward the box end;

guiding the pin end with the guide into the box end; and with the guide in a closed condition, pulling the guide laterally off of the first and second tubular with a pulling force that is axially aligned with both a connection point of the pair of jaws and a center axis of the jaws, the pulling overcoming the biasing force and opening the guide.

18. The method of claim 17, wherein pulling the guide free of the first and second tubular closes the guide.

19. The method of claim 17, wherein pulling guide releases a detent mechanism.

* * * * *